US009903055B2

(12) United States Patent
Todokoro

(10) Patent No.: US 9,903,055 B2
(45) Date of Patent: Feb. 27, 2018

(54) MANUAL KNITTING DEVICE

(71) Applicant: AGATSUMA CO., LTD, Tokyo (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 0 days.

(21) Appl. No.: 15/340,130

(22) Filed: Nov. 1, 2016

(65) Prior Publication Data

US 2017/0130375 A1 May 11, 2017

(30) Foreign Application Priority Data

Nov. 10, 2015 (JP) ..... 2015-220130
Jun. 7, 2016 (JP) ..... 2016-113197

(51) Int. Cl.
*D04B 5/00* (2006.01)
*D04B 3/00* (2006.01)

(52) U.S. Cl.
CPC *D04B 5/00* (2013.01); *D04B 3/00* (2013.01)

(58) Field of Classification Search
CPC ..... D04B 5/00; D04B 3/00; D04B 39/00
See application file for complete search history.

(56) References Cited

U.S. PATENT DOCUMENTS 2,292,356 A * 8/1942 Belanger ..... D03D 29/00 28/152
2,433,307 A * 12/1947 Wimberly ..... D03D 29/00 28/152
2,610,436 A * 9/1952 Honeycutt ..... B68G 7/08 112/2.2
3,678,709 A * 7/1972 Nowicki ..... D04B 39/00 66/4
3,800,372 A * 4/1974 Daoust ..... D03D 29/00 28/152
4,023,245 A 5/1977 Zaltzman
4,248,063 A * 2/1981 Wang ..... D04B 3/00 66/4

(Continued)

FOREIGN PATENT DOCUMENTS

JP 2010-514954 A 5/2010
WO 2008083095 A2 7/2008

OTHER PUBLICATIONS

Extended European Search Report from the Munich Patent Office in European Application No. EP 16193649.7-1710 dated Apr. 4, 2017.

*Primary Examiner* — Danny Worrell
(74) *Attorney, Agent, or Firm* — The Marbury Law Group, PLLC

(57) ABSTRACT

To provide a manual knitting device which can prepare easily a plurality of kinds of pieces of knitted fabric, a manual knitting device includes a plurality of pin members. The pin member is formed by a shaft portion and a protuberant portion which is formed on the shaft portion. A first base member having a shirt rod shape has a first common hole portion which is formed so that the shaft portion of the pin member can be inserted thereinto. Similarly, a second base member having a short rod shape has a second common hole portion which is formed so that the shaft portion of the pin member can be inserted thereinto. The first base member and the second base member can be rotated relatively about the first common hole portion and the second common hole portion into which the pin member is commonly inserted.

10 Claims, 21 Drawing Sheets

(56) References Cited

U.S. PATENT DOCUMENTS

| | | | | | |
|---|---|---|---|---|---|
| 4,729,229 | A * | 3/1988 | Whicker | D04B 3/00 | 66/4 |
| 5,146,659 | A * | 9/1992 | Spriggs, II | D03D 29/00 | 139/29 |
| 5,231,742 | A * | 8/1993 | Macbain | D03D 29/00 | 139/34 |
| 7,506,524 | B2 * | 3/2009 | Gustin | D04B 5/00 | 66/1 A |
| 7,578,146 | B2 * | 8/2009 | Gustin | D04B 5/00 | 66/1 A |
| 8,316,894 | B2 * | 11/2012 | Schaub | D03D 29/00 | 139/1 R |
| 8,402,794 | B2 * | 3/2013 | Sasur | D04B 5/00 | 66/3 |
| 8,596,096 | B1 | 12/2013 | Russell et al. | | |
| 9,234,306 | B1 * | 1/2016 | Chang | D04B 5/00 | |
| D773,174 | S * | 12/2016 | Okuma | D3/26 | |
| 2011/0259465 | A1 | 10/2011 | Schaub | | |

* cited by examiner

MANUAL KNITTING DEVICE

CROSS-REFERENCE TO RELATED APPLICATION

This application is based upon and claims the benefit of priority under 35 USC 119 of the Japanese Patent Application Nos. 2016-113197 filed on Jun. 7, 2016 and 2015-220130 filed on Nov. 10, 2015, the entire disclosure of which, including the specifications, claims, drawings and abstracts, is incorporated herein by reference.

BACKGROUND OF THE INVENTION

Field of the Invention

The present invention relates to a manual knitting device for use in knitting yarn such as wool into knitted fabric.

Description of the Related Art

There have conventionally been provided manual knitting devices with which yarn such as wool can easily be knitted into a muffler or hat. For example, JP-T-2010-514954 (the term "JP-T" as used herein means a published Japanese translation of a PCT patent application) discloses a manual knitting device which includes a base member into which two long portions which are aligned parallel to each other are integrated. Then, a plurality of pin members each having a protuberant portion at an upper end portion thereof are provided on an upper surface of the base member so as to be erected therefrom. Grooves are provided on the shaft portions of the pin members so as to extend along the length of the shaft portions, and these grooves are disposed to face outwards.

In knitting yarn into knitted fabric with the manual knitting device disclosed in JP-T-2010-514954, firstly, yarn such as wool is sequentially hooked on the individual pin members. Then, a lower yarn portion of a yarn portion of the yarn which is disposed vertically on the shaft portion of each pin member is moved as being raised from a front side to a rear side of the pin member using a hooked needle or the like. Repeating operations like this causes the yarn to be knitted sequentially. After the yarn has been knitted completely, the knitted yarn is removed from the manual knitting device, and end portions are knitted together using a binding needle, whereby knitted fabric is completed.

The size of knitted fabric which is knitted by the manual knitting device disclosed by JP2010-514954 is determined by the size of the base member. Consequently, in the case of making a bracelet whose diameter is small, a small knitting device is selected, whereas in the case of making a hat whose diameter is large, a large knitting device is selected for use. In this way, since knitting devices are selected according to the size of knitted fabric to be made, the user needs to prepare a plurality of types of knitting devices having different sizes. Thus, the user needs to prepare a number of types of knitting devices which differ in size when he or she attempts to make various types of knitted fabric, which is troublesome.

SUMMARY OF THE INVENTION

An object of the invention is to provide a manual knitting device which can easily prepare a plurality of types of knitted fabric.

According to an aspect of the invention, there is provided a manual knitting device in which a first base member which includes a first common hole portion and a second base member which includes a second common hole portion are formed so as to rotate about the first common hole portion and the second common hole portion into which a pin member is inserted commonly as a rotation center.

According to the aspect of the invention, since the connecting state of the first base member and the second base member which are connected together can be changed as a result of the rotation of the first and second base members, it is possible to provide the manual knitting device which can easily make a plurality of types of knitted fabric.

BRIEF DESCRIPTION OF THE SEVERAL OF THE DRAWINGS

DETAILED DESCRIPTION OF THE PREFERRED EMBODIMENTS

Figure 1:
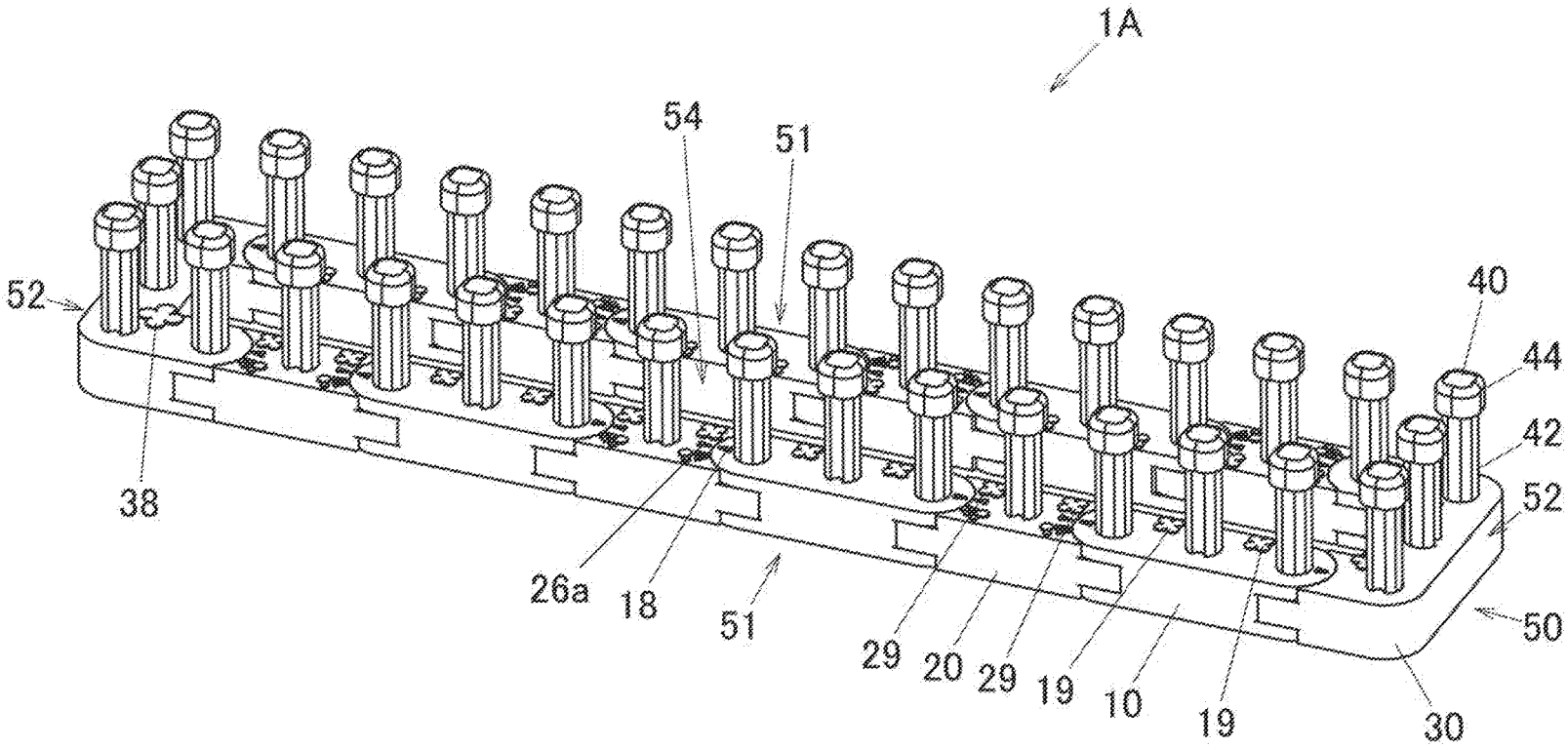
FIG. 1 is a perspective view showing a state in which a manual knitting device according to a first embodiment of the invention is built up into a rectangular configuration.

A first embodiment of the invention will be described by using the drawings. According to the first embodiment, three forms of manual knitting devices are possible. According to a manual knitting device 1A shown in FIG. 1, short rod-shaped first base members 10 and second base members 20 and two substantially U-shaped third base members 30 are connected together so as to form a base 50. Consequently, when seen from thereabove, the base 50 has a long rectangular shape in which an opening portion 54 is formed inside long side portions 51 and short side portions 52. Then, a plurality of pin members 40 are provided on an upper surface of the base 50 so as to be erected therefrom. The pin members 40 each have a shaft portion 42 and a protuberant portion 44 which is formed at an upper end of the shaft portion 42.

Figure 2:
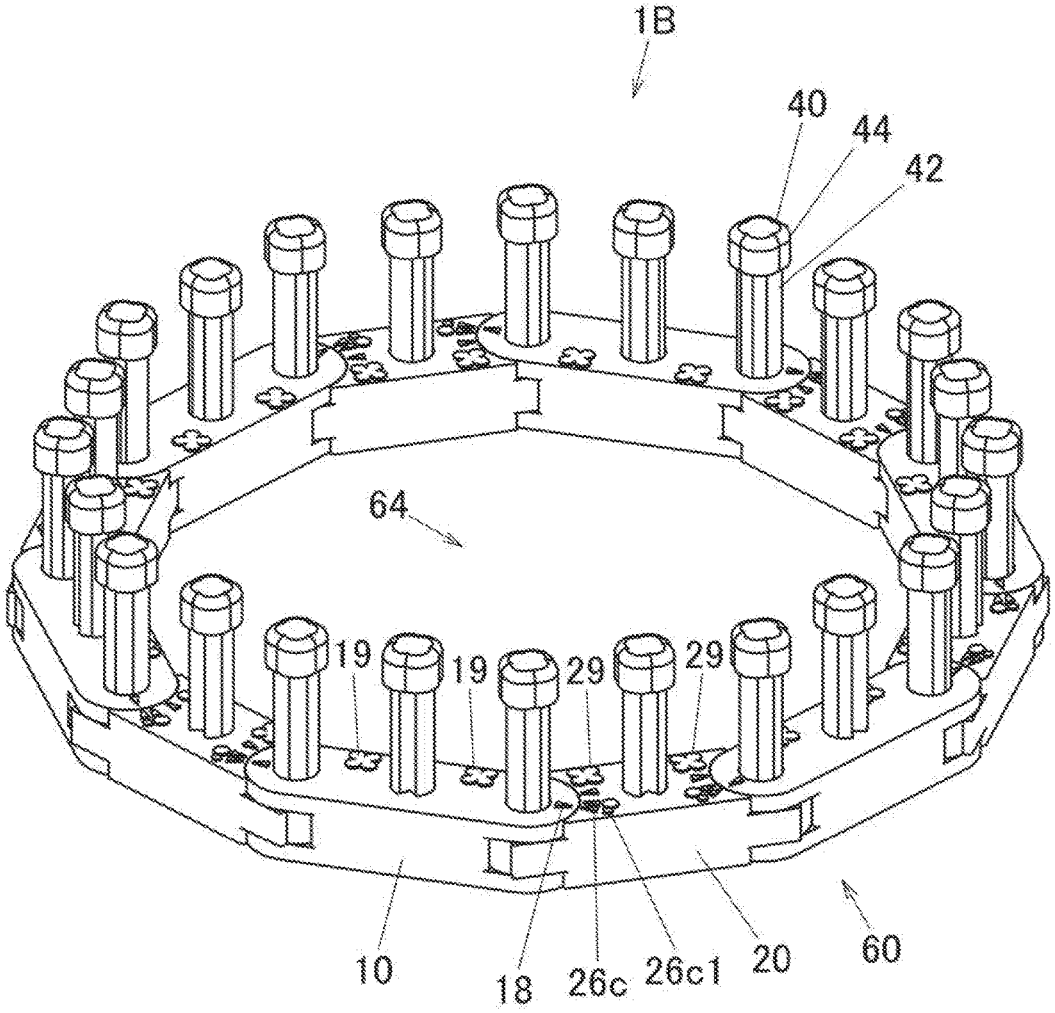
FIG. 2 is a perspective view showing a state in which the manual knitting device according to the first embodiment of the invention is built up into a circular configuration.

FIG. 2 shows a manual knitting device 1B of another form. In this manual knitting device 1B, the first base members 10 and the second base members 20 are connected together so as to form a circular base 60 when seen from thereabove. Consequently, an opening portion 64 is formed inside the base 60. Then, the pin members 40 are provided on an upper surface of the base 60 so as to be erected therefrom.

Figure 3:
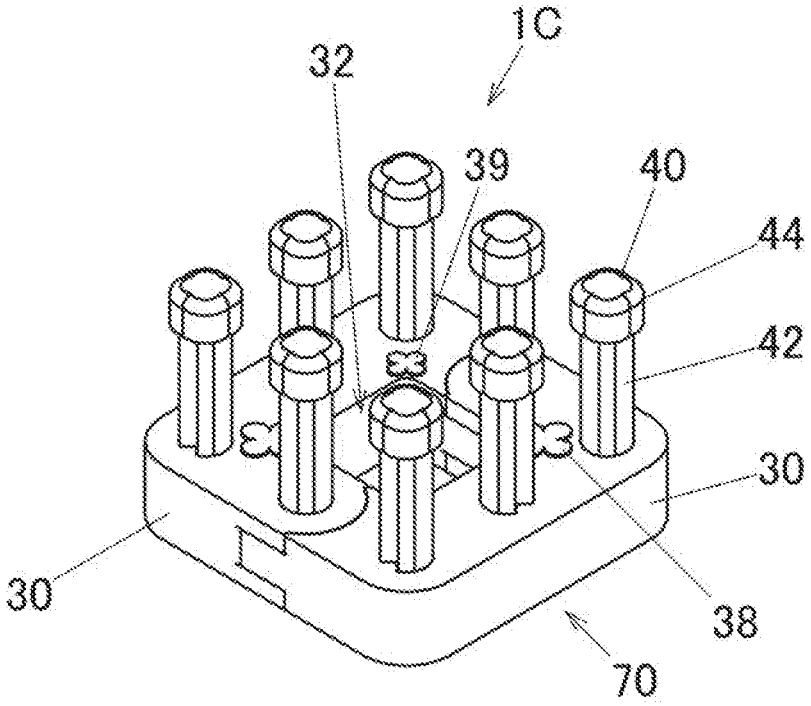
FIG. 3 is a perspective view showing a state in which third base members of the manual knitting device according to the first embodiment of the invention are combined together.

FIG. 3 shows a manual knitting device 1C of a further form. In this manual knitting device 1C, the two third base members 30 are combined together so as to form a quadrangular base 70 when seen from thereabove. The pin members 40 are provided on an upper surface of the base 70 so as to be erected therefrom.

In these manual knitting devices 1A, 1B, 1C, yarn such as wool is wound once around the individual pin members 40 sequentially, and part of the yarn so wound around each of the pin members 40 is turned from an outer side to an inner side of the pin member 40 in such a way that the yarn passes over an upper end of the protuberant portion 44, whereby knitting is executed. Then, the sequence of winding the yarn around the pin members 40 is changed variously, whereby various stitches can be produced. Further, by using the bases 50, 60, 70 which are different in shape and size, it is possible to make knitted fabric such as hats or mufflers of different sizes.

Figure 4A:
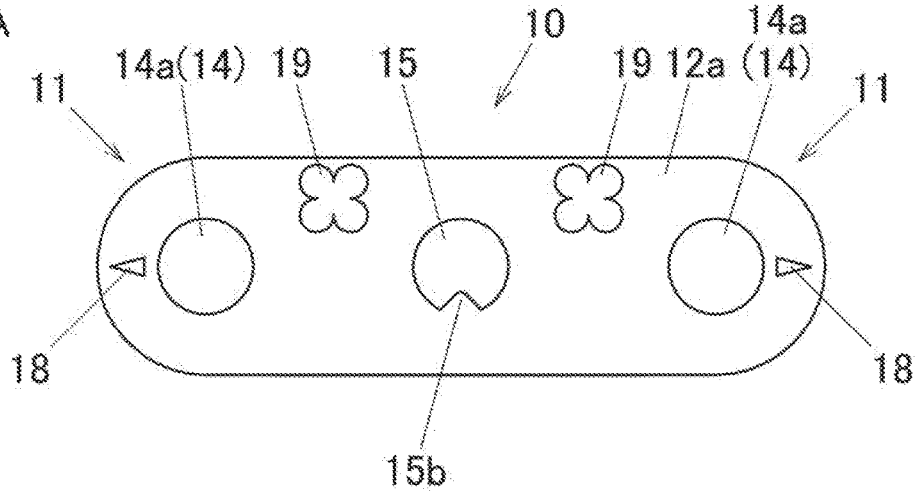
FIG. 4A is a plan view showing a first base member of the manual knitting device according to the first embodiment of the invention.
Figure 4B:
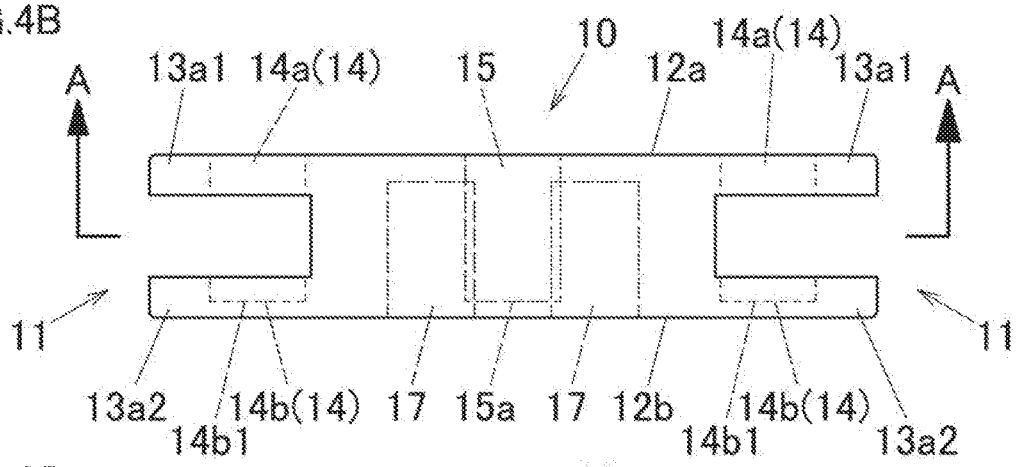
FIG. 4B is a front view showing the first base member of the manual knitting device according to the first embodiment of the invention.

Next, the first base member 10 will be described based on FIG. 4A to 4C. As shown in FIG. 4A, the first base member 10 having a short rod shape is formed into a short flat plate whose end portions 11 each have a convexly projecting arc shape when seen from thereabove. Consequently, an upper surface 12*a* and a lower surface 12*b* of the first base member 10 are formed substantially flat. Then, as shown in FIG. 4B, when seen from the front, the end portions 11 of the first base member 10 are each bifurcated. Here, an upper surface of an upper piece 13*a*1 of each of the bifurcated end portions 11 constitutes a surface which continues flat to the upper surface 12*a* of the first base member 10. Similarly, a lower surface of a lower piece 13*a*2 of each of the bifurcate end portions 11 constitutes a surface which continues to the lower surface 12*b* of the first base member 10.

The first base member 10 has first common hole portions 14 which are holes opened in a vertical direction at the end portions 11. The first common hole portions 14 are formed so that the shaft portion 42 of the pin member 40 can be inserted therethrough. Namely, the first common hole portions 14 are holes which are opened slightly larger in diameter than an outside diameter of the shaft portion 42 so as to have a hole diameter which allows the shaft portion 42 of the pin member 40 to rotate freely therein. The first common hole portions 14 are each made up of an upper hole 14*a* which is opened in the upper piece 13*a*1 and a lower hole 14*b* which is opened in the lower piece 13*a*2 of the bifurcate end portion 11. The upper hole 14*a* penetrates the upper piece 13*a*1. The lower hole 14*b* does not penetrate the lower piece 13*a*2 and is hence a non-through hole having a hole bottom portion 14*b*1. The upper hole 14*a* and the lower hole 14*b* have the same diameter.

A first hole portion 15 is provided in a longitudinally middle position of the first base member 10, and this first hole portion 15 constitutes a hole which is opened in a vertical direction. The first hole portion 15 is a non-through hole having a hole bottom portion 15*a*. Then, when seen from thereabove as shown in FIG. 4A, the first hole portion 15 has an engaging projecting portion 15*b* which projects into a triangular shape towards a center of the hole. The engaging projecting portion 15*b* is formed to extend continuously from an open surface (that is, the upper surface 12*a*) to the hole bottom portion 15*a* of the first hole portion 15. The engaging projecting portion 15*b* is disposed on a side (a lower side in FIG. 4A) of the first hole portion 15 which constitutes an outer side when the first base member 10 is connected to the other base members.

Figure 4C:
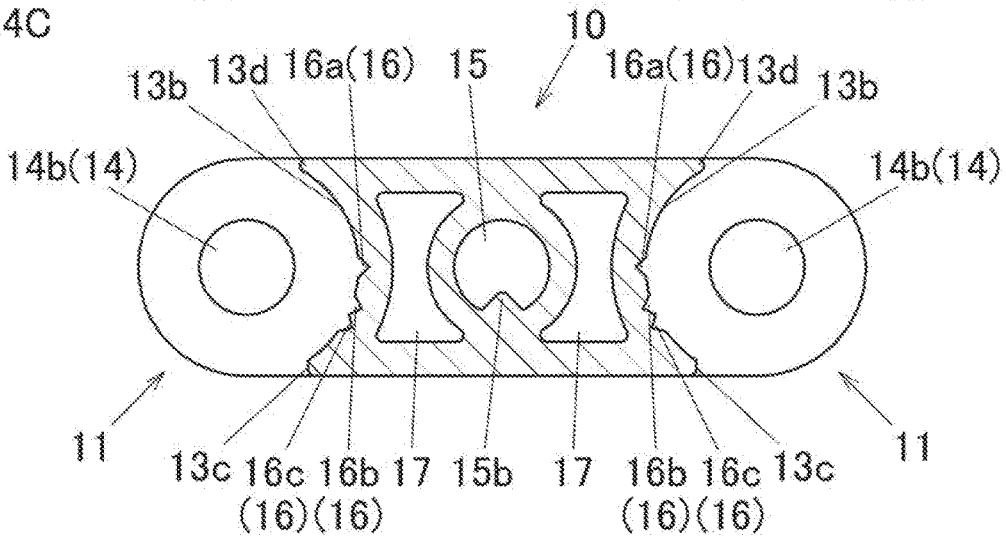
FIG. 4C is a sectional view of the first base member of the manual knitting device according to the first embodiment of the invention taken along a line A-A in FIG. 4B.

As shown in FIG. 4C, when seen from thereabove, inter-piece walls 13*b* each having a concavely receding arc shape constitute proximal or base portions of the bifurcate end portions 11 from which the upper pieces 13*a*1 and the lower pieces 13*a*2 project. The inter-piece walls 13*b* each have three connecting engagement recess portions 16 which include a first engaging recess portion 16*a*, a second engaging recess portion 16*b* and a third engaging recess portion 16*c*. The connecting engagement recess portions 16 are V-shaped grooves which are formed on the inter-piece wall portion so as to extend therealong in the vertical direction. The first engaging recess portion 16*a* is provided in a middle position of the arc-shaped inter-piece wall 13*b* when seen from thereabove. The second engaging recess portion 16*b* and the third engaging recess portion 16*c* are provided to lie adjacent to each other on one side (a lower side in FIG. 4C) of the inter-piece wall 13*b*. Further, an end portion of (a lower end portion in FIG. 4C) of each inter-piece wall 13*b* is formed into a flat step-like abutment end portion 13*c*. A step portion 13*d* is formed at the other end portion (an upper end portion in FIG. 4C) of each inter-piece wall 13*b*.

Space portions 17 are formed individually on longitudinal sides of the first hole portion 15 of the first base member 10. These space portions 17 are non-through spaces which are formed to extend upwards from the lower surface 12*b*. These space portions 17 constitute a so-called material removed portion resulting when the first base member 10 is formed from a resin material through injection molding.

A triangular rotational position mark 18 is provided an end portion of each of the end portions 11 on the upper surface 12*a* of the first base member 10. The rotational position marks 18 are disposed on a line which connects centers of the two first common hole portions 14, and top portions of the rotational position marks 18 are directed longitudinally outwards of the first base member 10. A setting mark 19 is provided between each of the two first common hole portions 14 and the first hole portion 15. The setting mark 19 has a shape which is copied from so-called four-lobed clover. The setting marks 19 are disposed near a longitudinal edge (an upper edge in FIG. 4A) of the first base member 10 which lies on an opposite side of the first hole portion 15 to a side thereof where the engaging projecting portion 15*b* is provided.

Figure 5A:
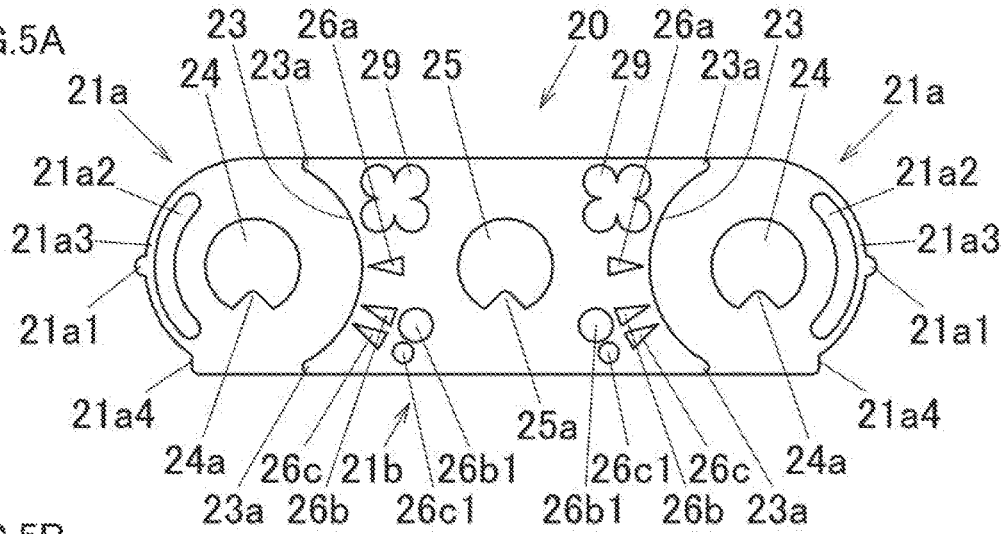
FIG. 5A is a plan view showing a second base member of the manual knitting device according to the first embodiment of the invention.

Next, the second base member 20 will be described based on FIG. 5A to 5C. As a plan view shown in FIG. 5A shows, the second base member 20 having a short rod shape is formed into a short flat plate whose end portions 21*a* have a convexly projecting arc shape. The end portions 21*a* are made thinner than a central portion 21*b* which lies between the end portions 21*a*. The end portions 21*a* have a thickness which enables the end portions 21*a* to be inserted into the bifurcate end portions 11 (between the upper piece 13*a*1 and the lower piece 13*a*2) of the adjacent first base members 10.

A second common hole portion 24 is formed in each end portion 21*a* so as to extend therethrough. An engaging projecting portion 24*a* is provided on each second common hole portion 24. The engaging projecting portions 24*a* each have a triangular projection, when seen from thereabove, which is formed from an upper end to a lower end of the second common hole portion 24 so as to extend along the length thereof with an apex portion thereof caused to face the center of the second common hole portion 24.

A connecting engagement projecting portion 21*a*1 is provided in a central position of an outer end of each of the end portions 21*a* when seen from thereabove. The connecting engagement projecting portions 21*a*1 are formed so as to extend from an upper surface to a lower surface of the corresponding end portions 21*a*. An arc-shaped hole 21*a*2, which is a through hole, is provided between each of the second common hole portions 24 and each of the connecting engagement projecting portions 21*a*1. Consequently, the connecting engagement projecting portions 21*a*1 are supported by corresponding arc-shaped base portions 21*a*3 which constitute base portions of the connecting engagement projecting portions 21*a*1. Since the second base member 20 is formed from a synthetic resin, the connecting engagement projecting portions 21*a*1 are allowed to be elastically sprung back by the arc-shaped base portions 21*a*3.

A flat abutment end portion 21*a*4 is formed at an end portion (that is, a lower end portion in FIG. 5C) of each of the arc-shaped base portions 21*a*3 in a step-like fashion. Further, proximal end walls 23, each having an arc shape when seen from thereabove, are formed individually on an upper side and a lower side of each of the end portions 21*a* at a connecting portion of the end portion 21*a* and the central portion 21*b* so as to be erected in the vertical direction. Both ends of each proximal end wall 23 are formed into a step portion 23*a*.

A second hole portion 25 is provided in a longitudinal center of the second base member 20, and this second hole portion 25 has the same diameter as that of the second common hole portion 24. The second hole portion 25 is a non-through hole and has a hole bottom portion 25*b*. Further, as with the engaging projecting portion 24*a* of the second common hole portion 24, the second hole portion 25 has a triangular engaging projecting portion 25*a* which is formed so as to extend from an upper surface 22*a* to the hole bottom portion 25*b* with an apex portion caused to face the center of the hole.

The second hole portion 25 and the two second common hole portions 24 have the same diameter and shape. The engaging projecting portions 24*a*, 25*a* of the two common hole portions 24 and the second hole portion 25 are disposed so as to be aligned along one side (a lower side in FIG. 5A) of the second base member 20 which represents an outer side when assembled to the first member 10. Then, the diameters of the second hole portion 25 and the two second common hole portions 24 are slightly larger than an outside diameter of the shaft portion 42 of the pin member 40, so that the shaft portion 42 can be inserted through the hole portions.

Space portions 27, which are non-through holes, are formed individually on longitudinal sides of the second hole portion 25 so as to extend upwards from a lower surface 22*b* of the central portion 21*b* of the second base member 20. These space portions 27 constitute a so-called material removed portion resulting when the second base member 20 is formed from a resin material through injection molding.

Triangular first marks 26*a* are disposed individually on the sides of the second hole portion 25 on a line which connects the centers of the two second common holes 24 and the second hole portion 25 on the upper surface 22*a* of the central portion 21*b* of the second base member 20. In addition, a second mark 26*b* and a third mark 26*c* are disposed adjacent to each other on one side (a lower side in FIG. 5A) of the first mark 26*a* at each end of the central portion 21*b*. Further, a large circular mark 26*b*1 is provided on a side of the second mark 26*b* which faces the second hole portion 25 so as to correspond to the second mark 26*b* at each end of the central portion 21*b*. Similarly, a small circular mark 26*c*1 is provided so as to correspond to the third mark 26*c*. Furthermore, two setting marks 29 each having a shape which is copied from so-called four-lobed clover are disposed on the sides of the second hole portion 25 on the upper surface 22*a* so as to be aligned near a longitudinal edge portion of the second base member 20 which lies on opposite sides of the second common hole portions 24 to sides thereof where the engaging projecting portions 24*a* are provided.

Figure 6A:
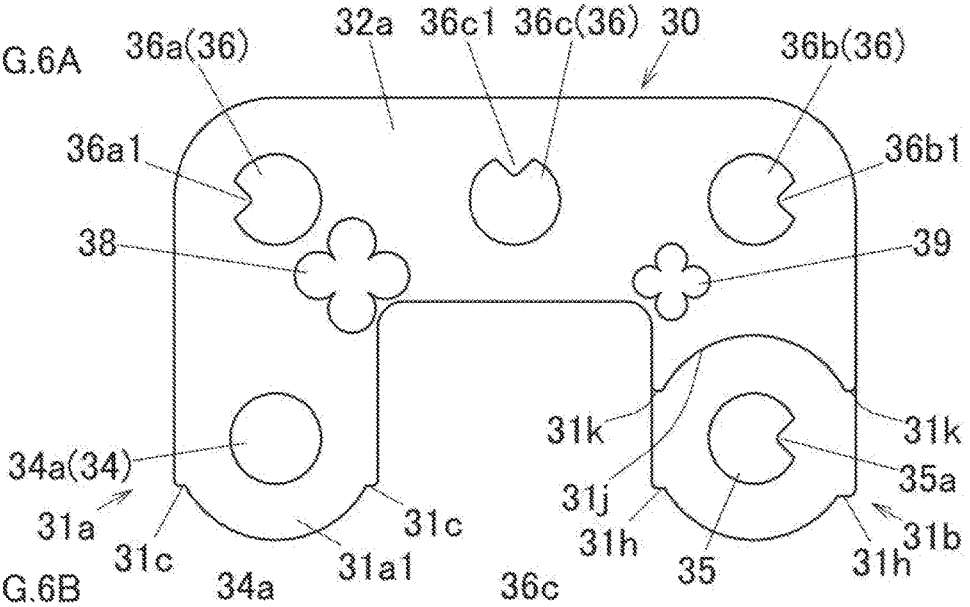
FIG. 6A is a plan view showing the third base member of the manual knitting device according to the first embodiment of the invention.
Figure 6B:
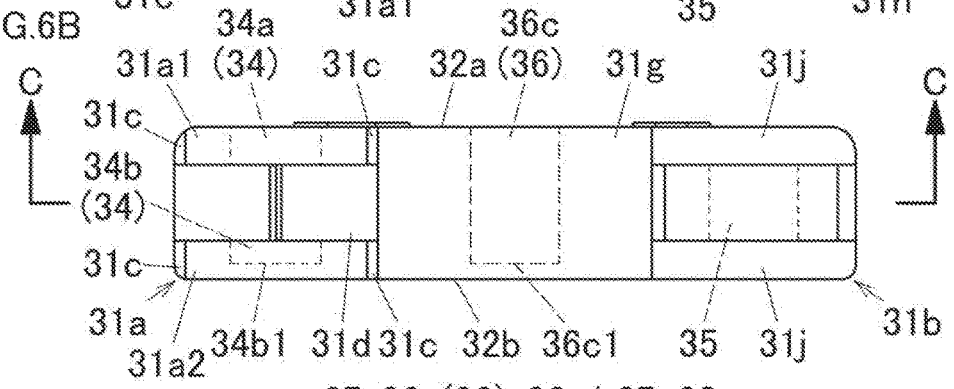
FIG. 6B is a front view showing the third base member of the manual knitting device according to the first embodiment of the invention.

Next, the third base member 30 will be described based on FIG. 6A to 6C. The third base member 30 is formed into a flat plate having a substantially U-shaped external shape when seen from thereabove. As a plan view shown in FIG. 6A shows, two projecting end portions 31*a*, 31*b* of the third base member 30 each have a convexly projecting arc shape. In FIG. 6A, a left projecting end portion 31*a* is bifurcated vertically. An upper surface of an upper piece 31*a*1 of the bifurcated end portion 31*a* includes a surface which continues flat to an upper surface 32*a* of a main body portion 31*g*. A lower surface of a lower piece 31*a*2 includes a surface which continues flat to a lower surface 32*b* of the main body portion 31*g*. Step portions 31*c* are formed individually at ends of a convexly projecting arc-shaped end face, which results when seen from thereabove, of each of the upper piece 31*a*1 and the lower piece 31*a*2 of the bifurcated projecting end portion 31*a*.

Figure 6C:
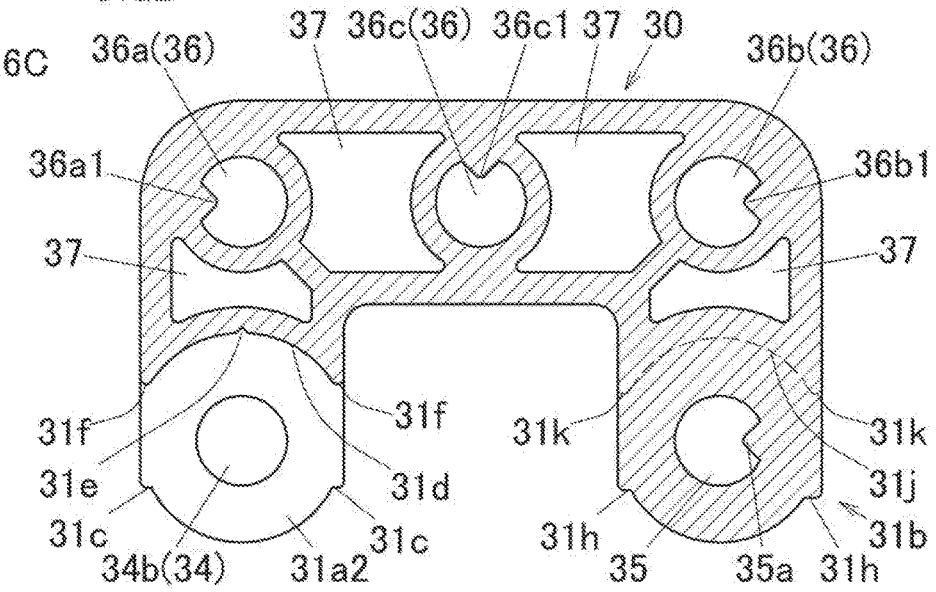
FIG. 6C is a sectional view of the third base member of the manual knitting device according to the first embodiment of the invention taken along a line C-C in FIG. 6B.

As a plan view shown in FIG. 6C shows, an inter-piece wall 31*d* which is formed at a proximal or base portion of the bifurcated projecting end portion 31*a* to which the upper piece 31*a*1 and the lower piece 31*a*2 connect has a concavely receding arc shape. An engaging recess portion 31*e* is formed into a V-shaped groove which extends in the vertical direction at a center of the inter-piece wall 31*d*. In addition, step portions 31*f* are formed individually at end portions of the inter-piece wall 31*d* having the concavely receding arc-shape when seen from thereabove.

A third common hole portion 34 is provided at the projecting end portion 31*a*. The third common hole portion 34 includes an upper hole 34*a* which penetrates the upper piece 31*a*1 and a lower hole 34*b* which is formed in the lower piece 31*a*2 as a non-through hole. Thus, the lower hole 34*b* has a hole bottom portion 34*b*1. The third common hole portion 34 has a diameter which is slightly larger than the outside diameter of the shaft portion 42 of the pin member 40 so that the shaft portion 42 can be inserted into the third common hole portion 34.

The other projecting end portion 31*b* is formed into a flat plate which is thinner than the main body portion 31*g*. Step portions 31*h* are formed individually at ends of the projecting end portion 31*b* having the convexly projecting arc shape when seen from thereabove. Further, a proximal or base portion of the other flat plate-shaped projecting end portion 31*b* is formed into proximal end walls 31*j* each having a concavely receding arc shape when seen from thereabove at a connecting portion with the main body portion 31g, and these proximal end walls 31*j* are formed individually one an upper side and a lower side of the projecting end portion 31*b*. Step portions 31*k* are formed individually at both ends of each of the upper and lower proximal end walls 31*j*.

Here, a portion lying between the upper piece 31*a*1 and the lower piece 31*a*2 of the bifurcated projecting end portion 31*a* is configured so as to receive therein the other flat plate-shaped projecting end portion 31*b* of the other third base member 30. Further, a space defined between the upper piece 31*a*1 and the lower piece 31*a*2 of the bifurcated projecting end portion 31*a* is the same as a space defined between the upper piece 13*a*1 and the lower piece 13*a*2 of each of the bifurcated end portions 11 of the first base member 10 shown in FIG. 4B. Additionally, a thickness of the other projecting end portion 31*b* of the third base member 30 is the same as a thickness of the end portions 21*a* of the second base member 20 shown in FIG. 5B. Thus, the projecting end portion 31*a* of the third base member 30 can be combined together with the other projecting end portion 31*b* of the other third base member 30 or one of the end portions 21*a* of the second base member 20. Similarly, the other projecting end portion 31*b* of the third base member 30 can be combined together with one of the end portions 11 of the first base member 10.

The other third common hole portion 35 is formed in the other projecting portion 31*b*. A triangular engaging projecting portion 35*a* is provided on the other third common hole portion 35 with an apex thereof caused to face the center of the hole. The engaging projecting portion 35*a* is formed so as to extend along the full length of the other third common hole portion 35 from an upper end to a lower end thereof.

The other third common hole portion 35 has such a diameter that enable the shaft portion 42 of the pin member 40 to be inserted thereinto.

In addition, third hole portions 36*a*, 36*b* are formed in two corner portions where the third base member 30 having the U-shape when seen from thereabove is bent. Further, a third hole portion 36*c* is also formed between the two third hole portions 36*a*, 36*b*. Engaging projecting portions 36*a*1, 36*b*1, 36*c*2 are formed on the third hole portions 36*a*, 36*b*, 36*c*, respectively, which are referred to as third hole portions 36 altogether. The third hole portions 36 have such a diameter that enables the shaft portion 42 of the pin member 40 to be inserted thereinto.

A knitting start mark 38 and a setting mark 39 are provided on an upper surface 32*a* of the main body portion 31*g* of the third base member 30. The knitting start mark 38 and the setting mark 39 have a shape which is copied from four-lobed clover. The knitting start mark 38 and the setting mark 39 are disposed on an opposite side of the engaging projecting portions 35*a*, 36*a*1, 36*c*1, 36*b*1 so that the knitting start mark 38 and the setting mark 39 are disposed near an inner edge of the third base member 30. The engaging projecting portions 35*a*, 36*a*1, 36*c*1, 36*b*1 are disposed on an outer side of the third base member 30.

Further, four space portions 37 are provided on the periphery of the third hole portions 36 on the main body portion 31*g* of the third base member 30 which is formed from a resin material through injection molding as so-called material removed portions. The space portions 37 are formed as non-through spaces.

As to the third members 30 which are formed in the way described above, the two third members 30 are combined together so as to form a small quadrangular base 70 as shown in FIG. 3.

Next, the pin member 40 will be described by reference to FIG. 7. The pin member 40 is made up of the shaft portion 42 and the protuberant portion 44 which is formed at the upper end of the shaft portion 42. The shaft portion 42 has a substantially cruciform cross section. Consequently, four groove portions 42*a* are formed on the shaft portion 42 so as to extend along an axial direction thereof. By adopting this configuration for the pin member 40, the pin member 40 provides a design of unification together with the setting marks 19, 29, 39 and the knitting start mark 38 of the first base member 10, the second base member 20 and the third base member 30. Thus, it is possible to enhance the aesthetic appearance of the manual knitting devices 1A, 1B, 1C. The shaft portion 42 is disposed about the axis thereof relative to the protuberant portion 44 in such a way that the groove portions 42*a* are matched individually to root lines 44*a* of the protuberant portion 44.

When the pin member 40 is inserted into the first hole portion 15 of the first base member 10 shown in FIG. 4A, anyone of the groove portions 42*a* of the shaft portion 42 is brought into engagement with the engaging projecting portion 15*b* of the first hole portion 15. Then, a lower end of the shaft portion 42 is brought into abutment with the hole bottom portion 15*a* of the first hole portion 15. This fixes the pin member 40 in place in the first hole portion 15 about the axis thereof. Similarly, also when the pin member 40 is inserted into the second hole portion 25 of the second base member 20 shown in FIG. 5A and the third hole portions 36*a*, 36*b*, 36*c* of the third base member shown in FIG. 6A, anyone of the groove portions 42*a* is brought into engagement with the engaging projecting portions 25*a*, 36*a*1, 36*b*1, 36*c*1. In this way, the groove portion 42*a* of the shaft portion 42 of the pin member 40 and each of the engaging projecting portions 15*b*, 24*a*, 25*a*, 36*a*1, 36*b*1, 36*c*1 make up an engaging portion.

Figure 5B:
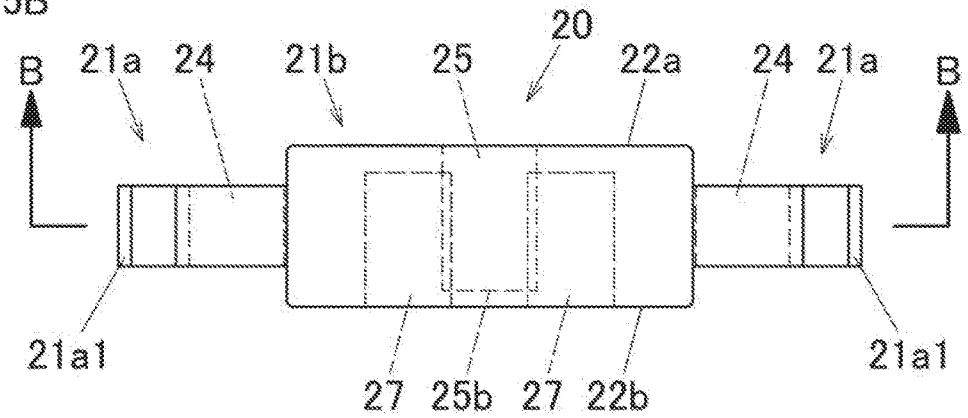
FIG. 5B is a front view showing the second base member of the manual knitting device according to the first embodiment of the invention.
Figure 5C:
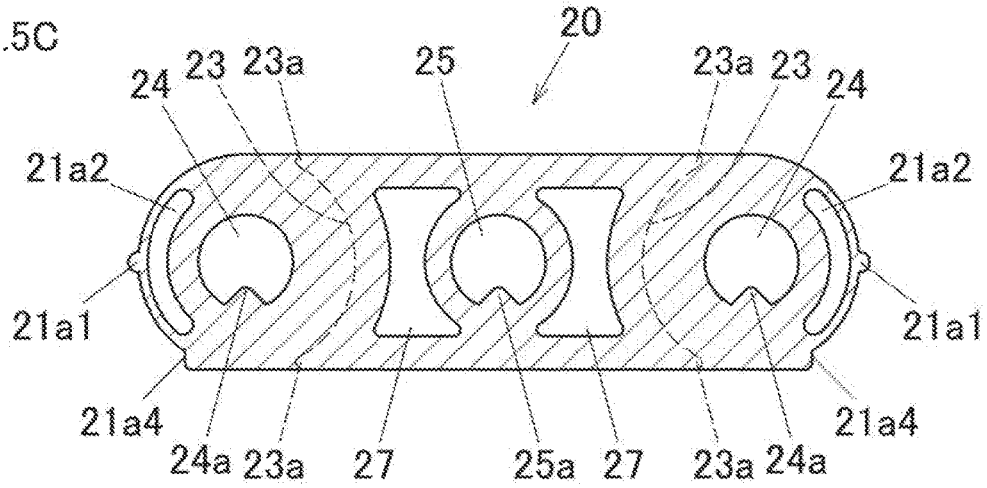
FIG. 5C is a sectional view of the second base member of the manual knitting device according to the first embodiment of the invention taken along a line B-B in FIG. 5B.

In addition, the pin member 40 can be inserted into a hole which is formed by the first common hole portion 14 and the second common hole portion 24 are combined together coaxially as a result of the first base member 10 shown in FIG. 4A to 4C and the second base member 20 shown in FIG. 5A to 5C being combined together. As this occurs, the groove portion 42*a* of the shaft portion 42 of the pin member 40 is brought into engagement with the engaging projecting portion 24*a* of the second common hole portion 24. The lower end of the shaft portion 42 is brought into abutment with the hole bottom portion 14*b*1 of the first common hole portion 14 (the lower hole 14*b*). Then, the first base member 10 and the second base member 20 are connected together so as to rotate relatively about the axis of the shaft portion 42 of the pin member 40 which is inserted commonly into the first common hole portion 14 and the second common hole portion 24.

Figure 8A:
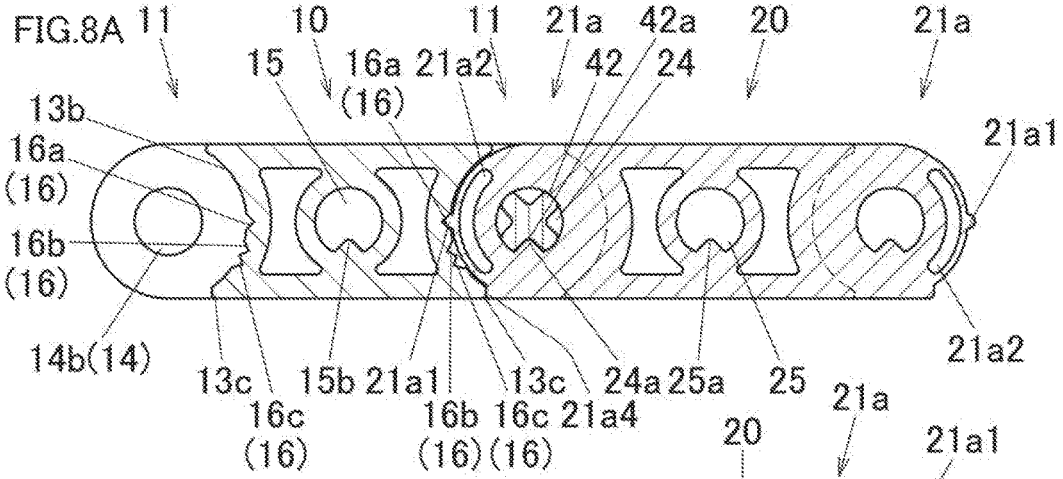
FIG. 8A is a horizontal sectional view showing a connecting state of the first member and the second member of the manual knitting device according to the first embodiment of the invention in which the first base member and the second base member are connected together in a straight line.
Figure 8B:
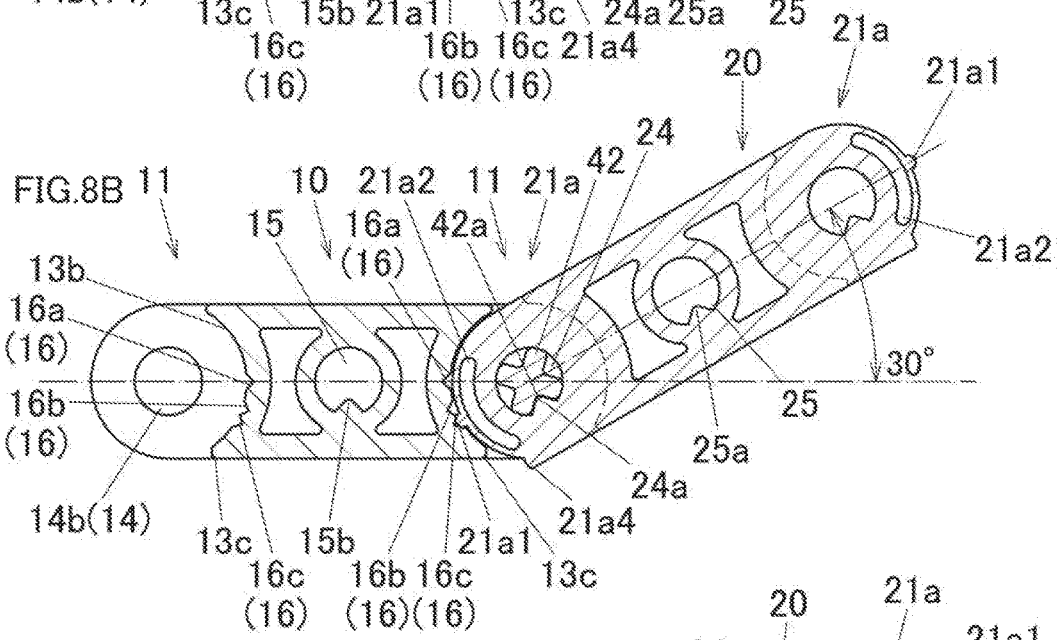
FIG. 8B is a horizontal sectional view showing a connecting state of the first base member and the second base member of the manual knitting device according to the first embodiment of the invention in which the first base member and the second base member are connected to each other at an angle of 30 degrees.
Figure 8C:
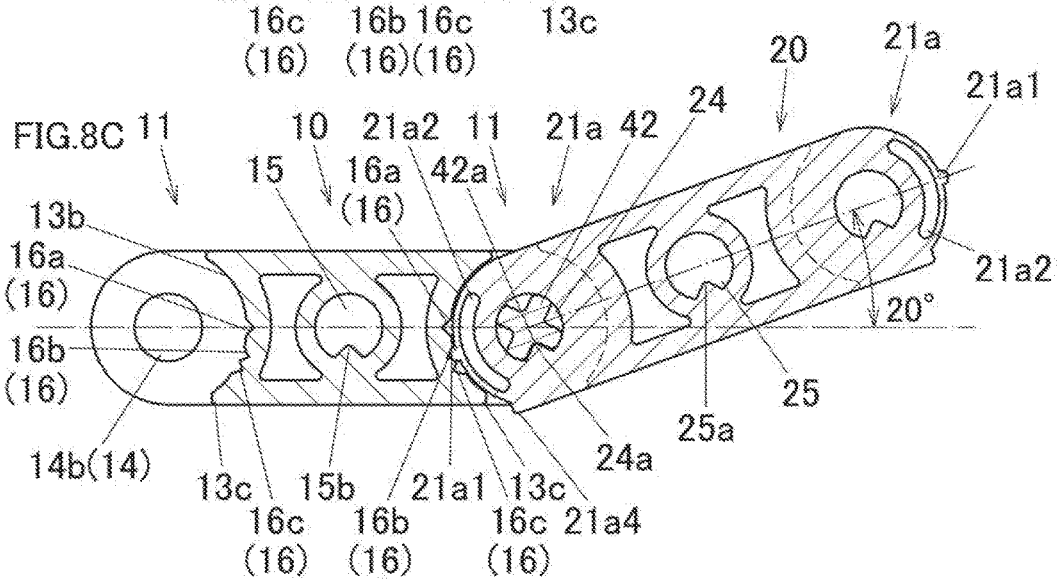
FIG. 8C is a horizontal sectional view showing a connecting state of the first base member and the second base member of the manual knitting device according to the first embodiment of the invention in which the first base member and the second base member are connected to each other at an angle of 20 degrees.

How the first base member 10 and the second base member 20 rotate relatively is shown in FIGS. 8A to 8C. FIG. 8A shows a state in which the connecting engagement projecting portion 21*a*1 of one of the end portions 21*a* of the second base member 20 is in engagement with the first engaging recess portion 16*a* of the other end portion 11 of the first base member 10. As this occurs, the first base member 10 and the second base member 20 are aligned in a straight line to be connected to each other.

The base 50 in the form shown in FIG. 1 can be made up by connecting the first base members 10 and the second base members 20 in a straight line, connecting the projecting end portion 31*a* of the third base member 30 with one of the end portions 21*a* of the second base member 20 and connecting the other projecting end portion 31*b* of the third base member 30 with one of the end portions 11 of the first base member 10. The base 50 so made up includes six first base members 10, six second base members 20 and two third base members 30.

Figure 9:
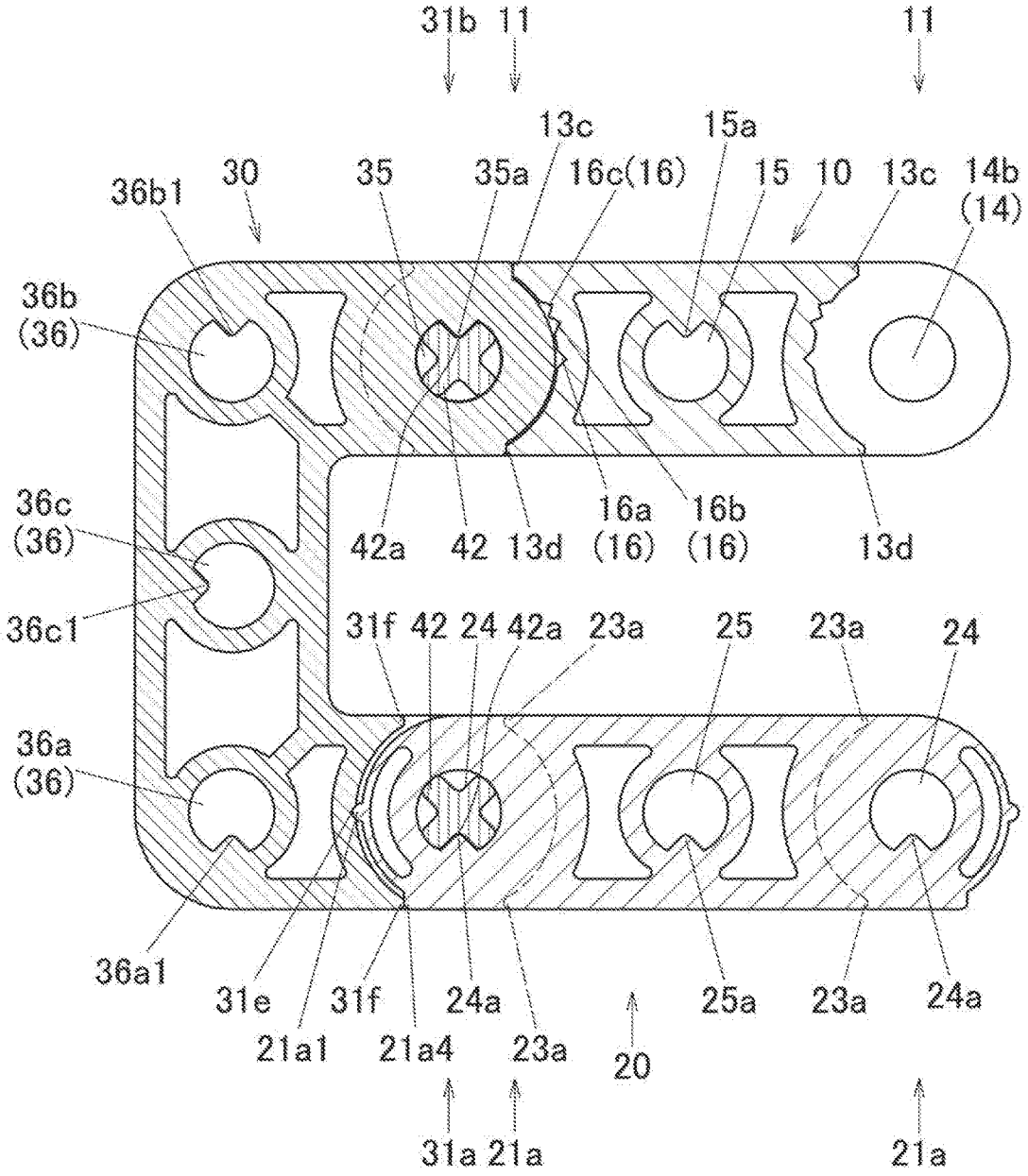
FIG. 9 is a horizontal sectional view showing a state in which the first base member and the second base member are connected to the third base member of the manual knitting member according to the first embodiment of the invention.

Here, as shown in FIG. 9, the projecting end portion 31*a* of the third base member 30 is connected with one of the end portions 21*a* of the second base member 20 by inserting the shaft portion 42 of the pin member 40 into the third common hole portion 34 of the third base member 30 and the second common hole portion 24 of the second base member 20 which are aligned coaxially in the vertical direction. As this occurs, the groove portion 42*a* of the shaft portion 42 of the pin member 40 is brought into engagement with the engaging projecting portion 24*a* of the second common hole portion 24, and the lower end of the shaft portion 42 is brought into abutment with the hole bottom portion 34*b*1. Consequently, the pin member 40 which is inserted commonly into the second common hole portion 24 and the third common hole portion 34 is fixed in place therein so as not to rotate about the axis thereof. When the third base member 30 and the second base member 20 are connected together, the connecting engagement projecting portion 21*a*1 of one of the end portions 21*a* of the second member 20 is brought into engagement with the engaging recess portion 31*e* of the third base member 30, and the abutment end portion 21*a*4 is brought into abutment with the step portion 31*f* of the third base member, whereby the rotation of the second base member 20 relative to the third base member 30 is restricted.

Similarly, the other projecting end portion 31*b* of the third base member 30 is connected with one of the end portions 11 of the first base member 10 by inserting the shaft portion 42 of the pin member 40 into the other third common hole portion 35 of the third base member 30 and the first common hole portion 14 of the first base member 10 which are aligned coaxially in the vertical direction. As this occurs, the groove portion 42*a* of the shaft portion 42 of the pin member 40 is brought into engagement with the engaging projecting portion 35*a* of the other third common hole portion 35, and the lower end of the shaft portion 42 is brought into abutment with the hole bottom portion 14*b*1. Consequently, the pin member 40 which is inserted commonly into the first common hole portion 14 and the other third common hole portion 35 is fixed in place therein so as not to rotate about the axis thereof. Additionally, as this occurs, the step portion 31*h* of the third base member 30 is brought into abutment with the abutment portion 13*c* of the first base member 10, whereby the first base member 10 is restricted from rotating relative to the third base member 30.

In the case of the base 50 being formed as shown in FIG. 1, the rotational position mark 18 of the first base member 10 is aligned with the first mark 26*a* of the second base member 20. In addition, in case the first base member 10, the second base member 20 and the third base member 30 are connected together by setting the members so that the respective setting marks 19, 29, 39 are caused to face inwards, the first, second and third base members can be combined together properly.

As shown in FIGS. 8B and 8C, the first base member 10 and the second base member 20 can be rotated relatively about the shaft portion 42 of the pin member 40 (in other words, about the axis of the first common hole portion 14 and the second common hole portion 24 which are aligned coaxially). In a state shown in FIG. 8B, the connecting engagement projecting portion 21*a*1 is brought into engagement with the third engaging recess portion 16*c*, whereby the first base member 10 and the second base member 20 are connected together at an angle of about 30 degrees. In the event that the first base member 10 and the second base member 20 are connected together in the way described above, the small circular base 60 shown in FIG. 2 or a small circular base 60 shown in FIG. 10A can be made up.

As this occurs, the rotational position mark 18 of the first base member 10 is aligned with the third mark 26*c* of the second base member 20. Consequently, even in the middle of combination, a connecting state between the first base member 10 and the second base member 20 can be grasped visually in an easy fashion by the small circular mark 26*c*1 which is provided so as to correspond to the third mark 26*c*.

On the other hand, in a state shown in FIG. 8C, the connecting engagement projecting portion 21*a*1 is brought into engagement with the second engaging recess portion 16*b*, whereby the first base member 10 and the second base member 20 are connected together at an angle of about 20 degrees. In this case, a large circular base 60A shown in FIG. 10B can be made up. As this occurs, the rotational position mark 18 of the first base member 10 is aligned with the second mark 26*b* of the second base member 20, whereby the connecting state between the first base member 10 and the second base member 20 can easily be grasped together with the large circular mark 26*b*1.

Figure 10A:
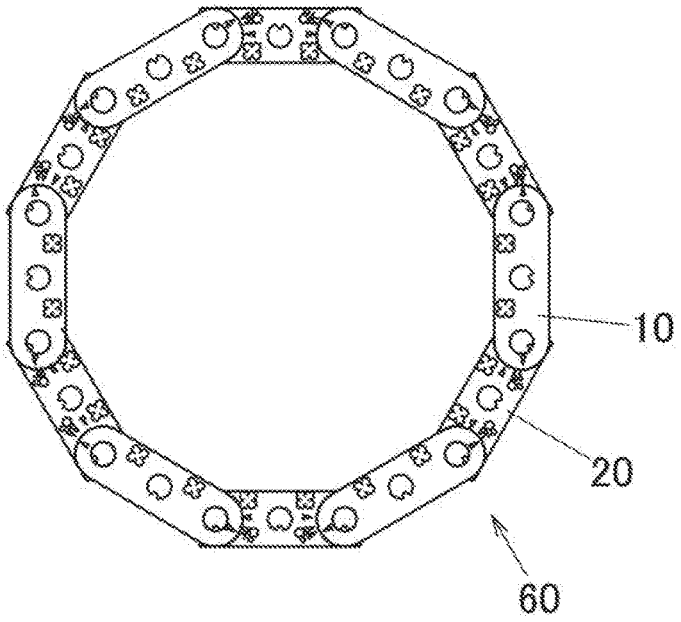
FIG. 10A is a plan view showing a state in which the first base members and the second base members of the manual knitting device according to the first embodiment of the invention are connected together into a circular shape, the first base members and the second base members being connected together so as to form a small circular shape.
Figure 10B:
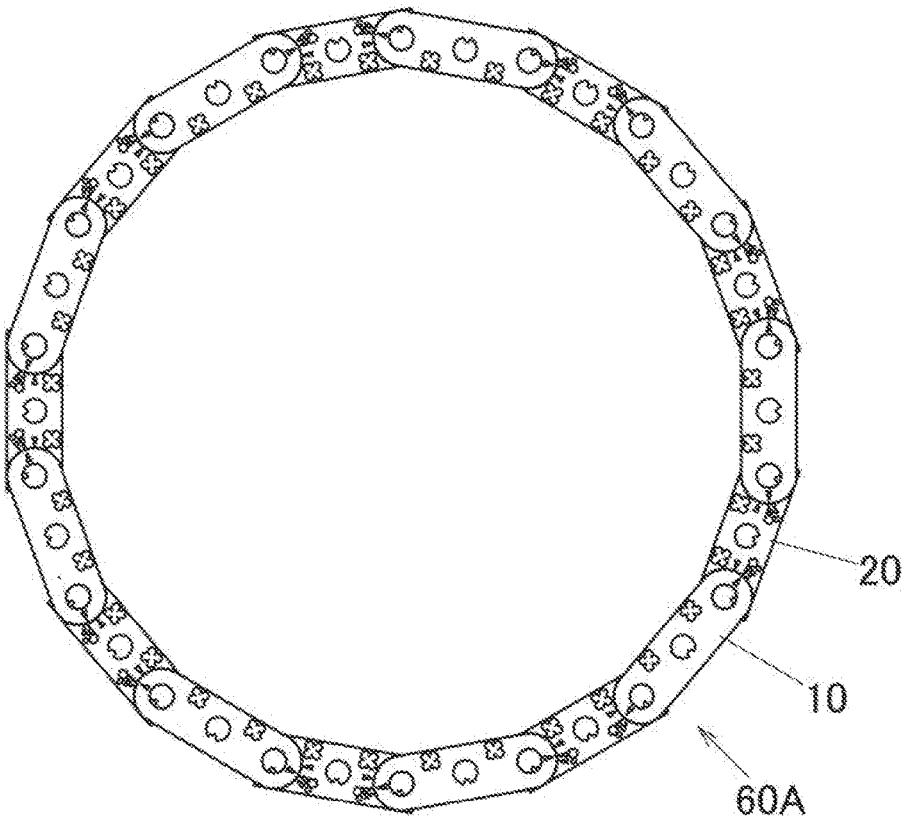
FIG. 10B is a plan view showing a state in which the first base members and the second base members of the manual knitting device according to the first embodiment of the invention are connected together into a circular shape, the first base members and the second base members being connected together so as to form a large circular shape.

The small circular base 60 shown in FIG. 10A includes six first base members and six second base members 20. The large circular base 60A shown in FIG. 10B includes nine first base members 10 and nine second base members 20.

As shown in FIG. 8A, the relative rotating direction of the first base member 10 and the second base member 20 is restricted to only one direction by the abutment of the abutment end portion 13*c* of the first base member 10 with the abutment end portion 21*a*4 of the second base member 20.

The connecting engagement portion made up of the connecting engagement recess portion 16 (the first engaging recess portion 16*a*, the second engaging recess portion 16*b*, the third engaging recess portion 16*c*) and the connecting engagement projecting portion 21*a*1 is made or released by the relative rotation of the first base member 10 and the second base member 20, whereby the relative rotational position between the first base member 10 and the second base member 20 can easily be determined. In particular, since the connecting engagement projecting portion 21*a*1 is elastically supported by the arc-shaped base portion 21*a*3, a touch of click is generated when the connecting engagement projecting portion 21*a*1 is brought into engagement with the connecting engagement recess portion 16, whereby the user can grasp the rotational position of the second base member 20 to the first base member 10 or vice versa.

Figure 11A:
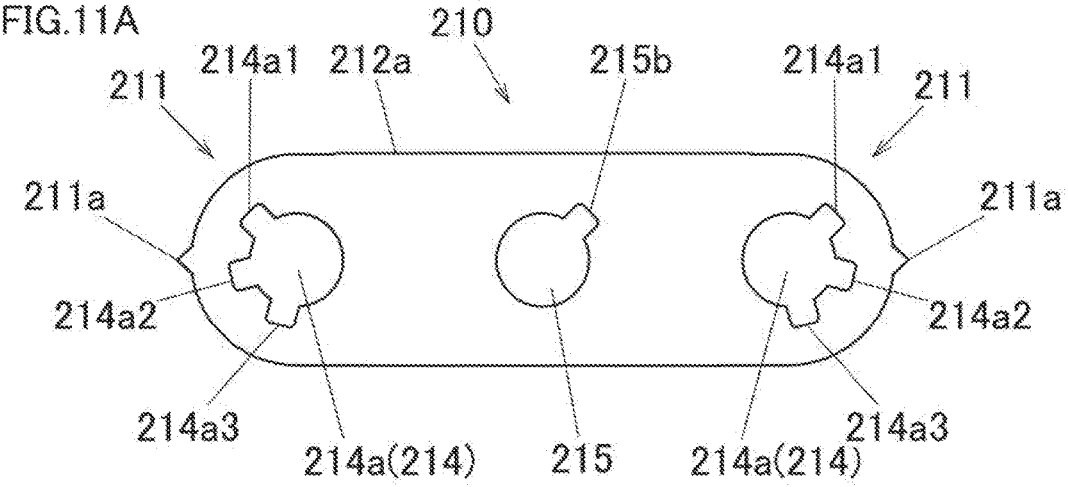
FIG. 11A is a plan view showing a first base member of a manual knitting device according to a second embodiment of the invention.
Figure 11B:
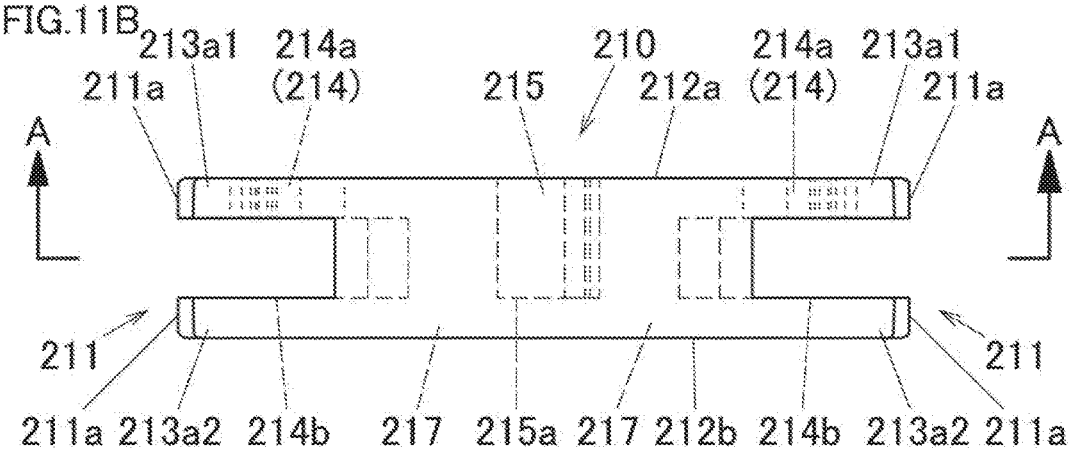
FIG. 11B is a front view showing the first base member of the manual knitting device according to the second embodiment of the invention.

Next, a first base member 210 will be described based on FIG. 11A to 11C. A first base member 210 having a short rod shape is formed into a short flat plate having end portions 211 which are each formed into a convexly projecting arc shape when seen from thereabove, as shown in FIG. 11A. Consequently, an upper surface 212*a* and a lower surface 212*b* of the first base member 210 are formed substantially flat. Then, as shown in FIG. 11B, the end portions 211 of the first base member 210 are bifurcated when seen from the front. Here, an upper surface of an upper piece 213*a*1 of each of the end portions 211 constitutes a surface which continues flat to the upper surface 212*a* of the first base member 210. Similarly, a lower surface of the lower piece 213*a*2 constitutes a surface which continues flat to the lower surface 212*b* of the first base member 210.

In the first base member 210, a first common hole portion 214 is formed in each of the end portions 211 in such a way as to be opened in a vertical direction. The first common hole portion 214 is formed so as to allow a shaft portion 242 of a pin member 240 to be inserted thereinto. Namely, the first common hole portion 214 is a hole which is opened to a diameter which is slightly larger than an outside diameter of the shaft portion 242. The first common hole portion 214 has such a hole diameter that enables the shaft portion 242 of the pin member 240 to rotate freely therein. The first common hole portion 214 includes an upper hole 214*a* which is formed in the upper piece 213*a*1 of the bifurcated end portion 211. The upper hole 214*a* penetrates the upper piece 213*a*1. The upper hole 214*a* has three engaging recess portions 214*a*1, 214*a*2, 214*a*3 which are formed at equal intervals in a circumferential direction. The engaging recess portions 214*a*1, 214*a*2, 214*a*3 project outwards from a circumference of the upper hole 214*a* into a quadrangular shape when seen from thereabove. A bottom surface 245 of the pin member 240 is brought into abutment with an upper surface 214*b* of the lower piece 213*a*.

A first hole portion 215, which is a hole opened in the vertical direction, is provided in a longitudinally middle position of the first base member 210. The first hole portion 215 constitutes a non-through hole and has a hole bottom portion 215*a*. As a plan view shown in FIG. 11A shows, an engaging recess portion 215*b* is formed in the first hole portion 215 in such a way as to project outwards from a circumference of the hole into a quadrangular shape when seen from thereabove. The engaging recess portion 215*b* is formed so as to extend continuously from an open surface of the first hole portion 215 (that is, the upper surface 212*a*) to the hole bottom portion 215*a*.

A connecting engagement projecting portion 211*a* is provided in a central position of an outer end of each of the end portions 211. The connecting engagement projecting portion 211*a* is formed so as to extend from an upper surface to a lower surface of each of the end portions 211.

Figure 11C:
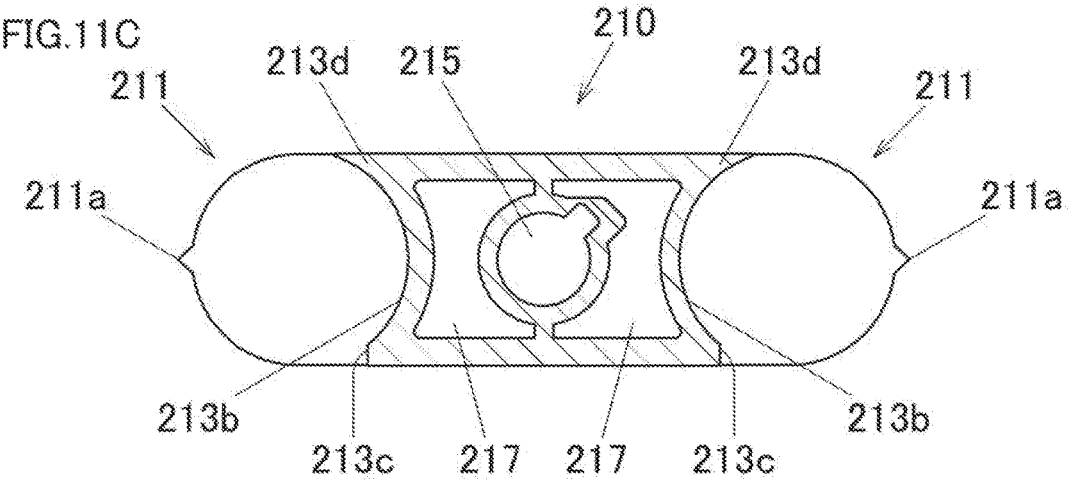
FIG. 11C is a sectional view of the first base member of the manual knitting device according to the second embodiment of the invention taken along a line A-A in FIG. 11B.

As shown in FIG. 11C, when seen from thereabove, inter-piece walls 213*b* each having a concavely receding arc shape constitute proximal or base portions of the bifurcated end portions 211 from which the upper pieces 213*a*1 and the lower pieces 213*a*2 project. In addition, an end portion of (a lower end portion in FIG. 11C) of each inter-piece wall 213*b* is formed into a flat step-like abutment end portion 213*c*. An acute angle portion 213*d* is formed at the other end portion (an upper end portion in FIG. 11C) of each inter-piece wall 21*b*.

Space portions 217 are formed individually on longitudinal sides of the first hole portion 215 of the first base member 210. These space portions 217 are non-through spaces which are formed so as to extend upwards from the lower surface 212*b*. These space portions 217 constitute a so-called material removed portion resulting when the first base member 210 is formed from a resin material through injection molding.

Figure 12A:
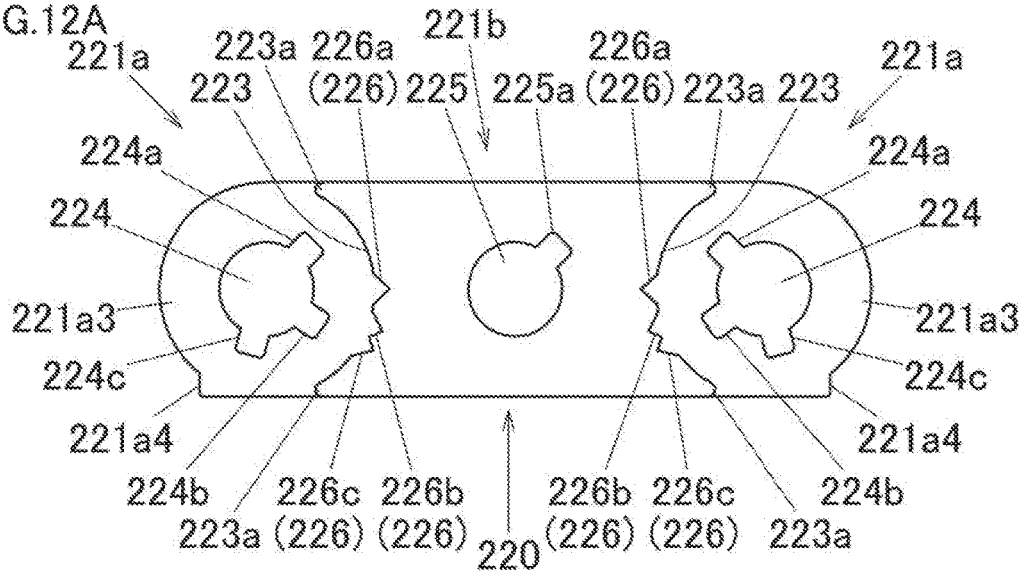
FIG. 12A is a plan view showing a second base member of the manual knitting device according to the second embodiment of the invention.
Figure 12B:
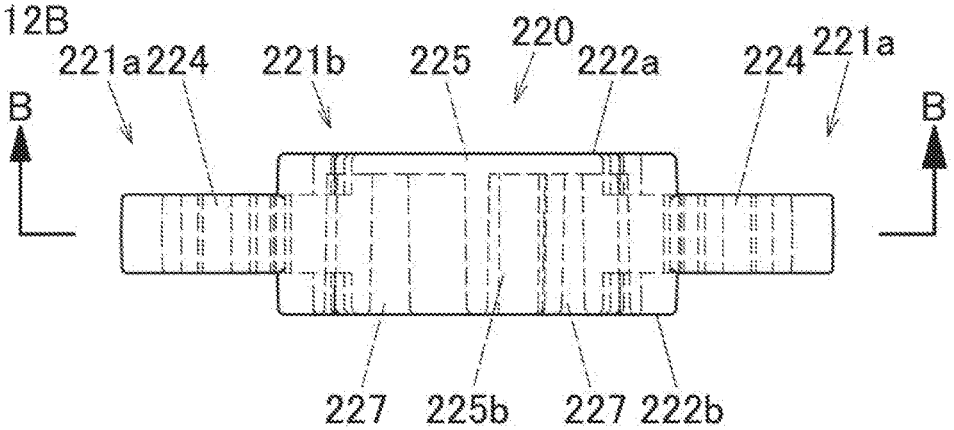
FIG. 12B is a front view showing the second base member of the manual knitting device according to the second embodiment of the invention.
Figure 12C:
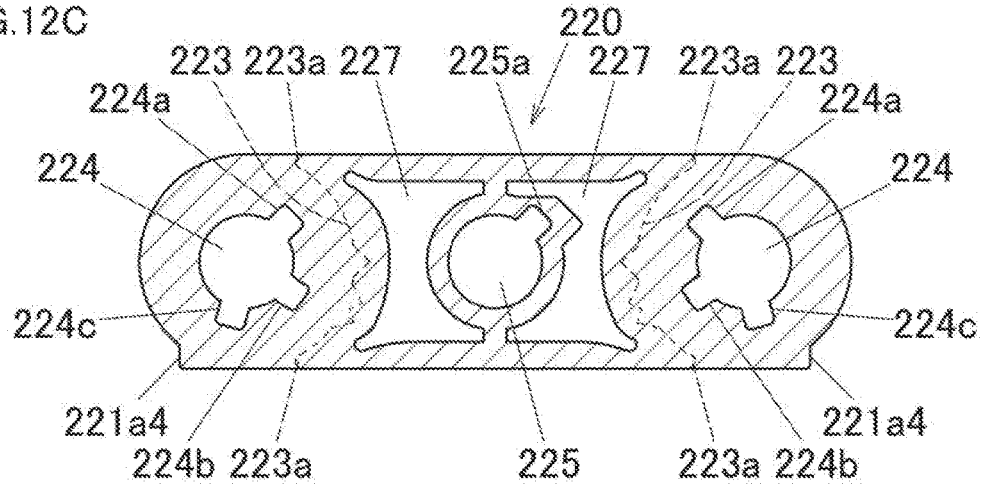
FIG. 12C is a sectional view of the second base member of the manual knitting device according to the second embodiment of the invention taken along a line B-B in FIG. 12B.

Next, a second base member 220 will be described based on FIG. 12A to 12C. As a plan view shown in FIG. 12A shows, the second base member 220 having a short rod shape is formed into a short flat plate whose end portions 221*a* have a convexly projecting arc shape. The end portions 221*a* are made thinner than a central portion 221*b* which lies between the end portions 221*a*. The end portions 221*a* have a thickness which enables the end portions 221*a* to be inserted into the bifurcated end portions 211 (that is, between the upper piece 213*a*1 and the lower piece 213*a*2) of the adjacent first base members 210.

Second common hole portions 224, which are through holes, are provided individually at both the end portions 221*a*. The second common hole portions 224 each have engaging recess portions 224*a*, 224*b*, 224*c*. The engaging recess portions 224*a*, 224*b*, 224*c* are formed at equal intervals in a circumferential direction on a circumference of the second common hole portion 224 as quadrangular recesses when seen from thereabove with bottom portions thereof caused to face outwards of the circumference of the second common hole portion 224. The intervals at which the engaging recess portions 224*a*, 224*b*, 224*c* of the second common hole portion 224 are disposed are larger than the intervals at which the engaging recess portions 214*a*1, 214*a*2, 214*a*3 of the first common hole portion 214 are disposed.

A step-like substantially flat abutment end portion 221*a*4 is formed at one end portion (that is, a lower end portion in FIGS. 12A, 12C) of each of arc-shaped base portions 221*a*3. Further, an upper and lower proximal end walls 223, each having an arc shape when seen from thereabove, are formed individually on an upper and lower sides of each of the end portions 221*a* at a connecting portion of the end portion 221*a* with the central portion 221*b*.

The inter-piece walls 213*b* each have three connecting engagement recess portions 226 which include a first engaging recess portion 226*a*, a second engaging recess portion 226*b* and a third engaging recess portion 226*c*. The connecting engagement recess portions 226 are formed on the proximal end wall 223 as V-shaped grooves which extend therealong in the vertical direction. The first engaging recess portion 226*a* is provided in a middle position of the arc-shaped proximal end wall 223 when seen from thereabove. The second engaging recess portion 226*b* and the third engaging recess portion 226*c* are provided to lie adjacent to each other on one side (a lower side in FIGS. 12A, 12C) of the proximal end wall 223. Acute angle portions 223*a* are formed individually at ends of each of the proximal end walls 223.

A second common hole portion 225 is provided in a longitudinal center of the second base member 220, and this second common hole portion 225 has a diameter which is the same as the diameter of the second common hole portions 224. The second hole portion 225 is a non-through hole and has a hole bottom portion 225*b*. Further, a quadrangular engaging recess portion 225*a* is formed on the second hole portion 225 so as to extend from an upper surface 222*a* to the hole bottom portion 225*b* with a bottom portion thereof caused to face outwards of a circumference of the hole.

The second hole portion 225 and the two second common hole portions 224 have the same diameter. The diameters of the second hole portion 225 and the two second common hole portions 224 are slightly larger than an outside diameter of the shaft portion 242 of the pin member 240, so that the shaft portion 242 can be inserted thereinto.

Space portions 227, which are non-through spaces, are formed individually on longitudinal sides of the second hole portion 225 so as to extend upwards from a lower surface 222*b* of the central portion 221*b* of the second base member. The space portions 227 are so-called material removed portions resulting when the second base member 220 is formed from a resin material through injection molding.

Figure 13A:
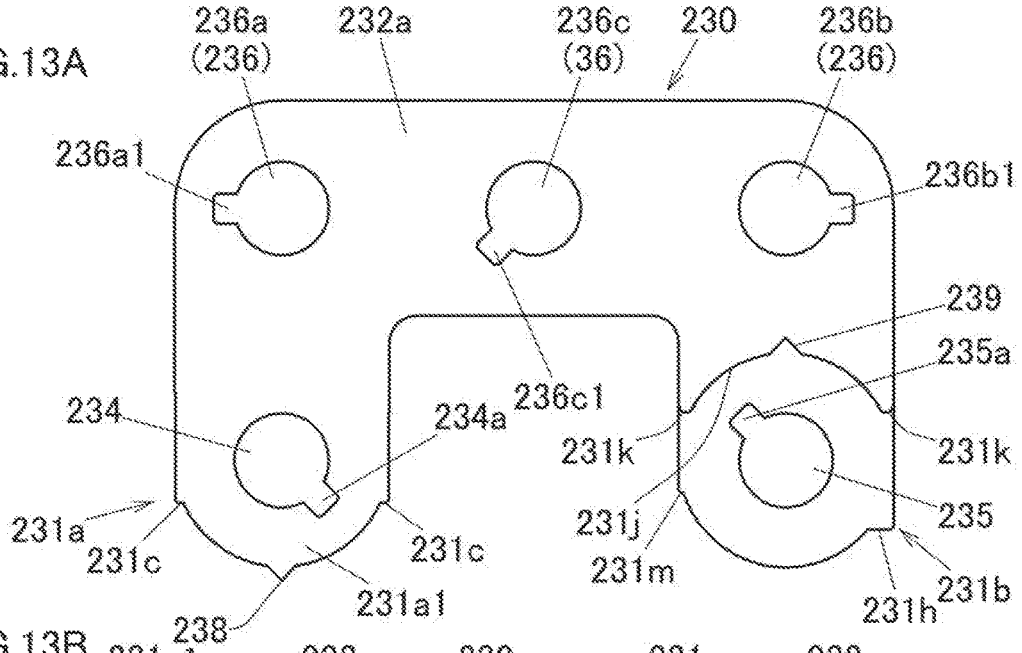
FIG. 13A is a plan view showing a third base member of the manual knitting device according to the second embodiment of the invention.
Figure 13B:
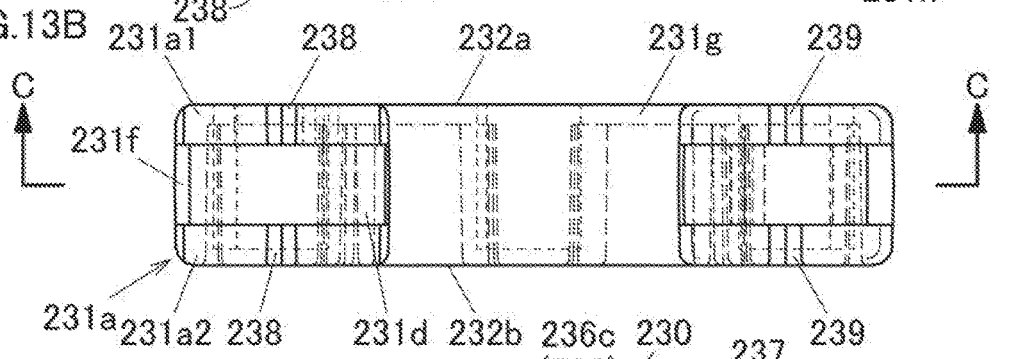
FIG. 13B is a front view showing the third base member of the manual knitting device according to the second embodiment of the invention.

Next, a third base member 230 will be described based on FIG. 13A to 13C. The third base member 230 is formed into a flat plate having a substantially U-shaped external shape when seen from thereabove. Two projecting end portions 231*a*, 231*b* of the third base member 230 each have a convexly projecting arc shape when seen from thereabove as shown in FIG. 13A. In FIG. 13A, a left projecting end portion 231*a* is bifurcated in the vertical direction. An upper piece 231*a*1 of the bifurcated projecting end portion 231*a* includes an upper surface which constitutes a surface which continues flat to an upper surface 232*g* of a main body portion 231*g*. A lower piece 231*a*2 of the bifurcated projecting end portion 231*a* includes a lower surface which constitutes a surface which continues flat to a lower surface 232*b* of the main body portion 231*g*.

A connecting engagement projecting portion 238 is provided in a central position of an outer end of the projecting portion 231*a* when seen from thereabove. The connecting engagement projecting portion 238 is formed so as to extend from the upper surface to a lower surface of the upper piece 231*a*1 and an upper surface to the lower surface of the lower piece 231*a*2 of the bifurcated projecting end portion 231. Step portions 231*c* are formed individually at ends of the upper piece 231*a*1 and the lower piece 231*a*2 of the projecting end portion 231*a* having the convexly projecting arc shape when seen from thereabove.

Figure 13C:
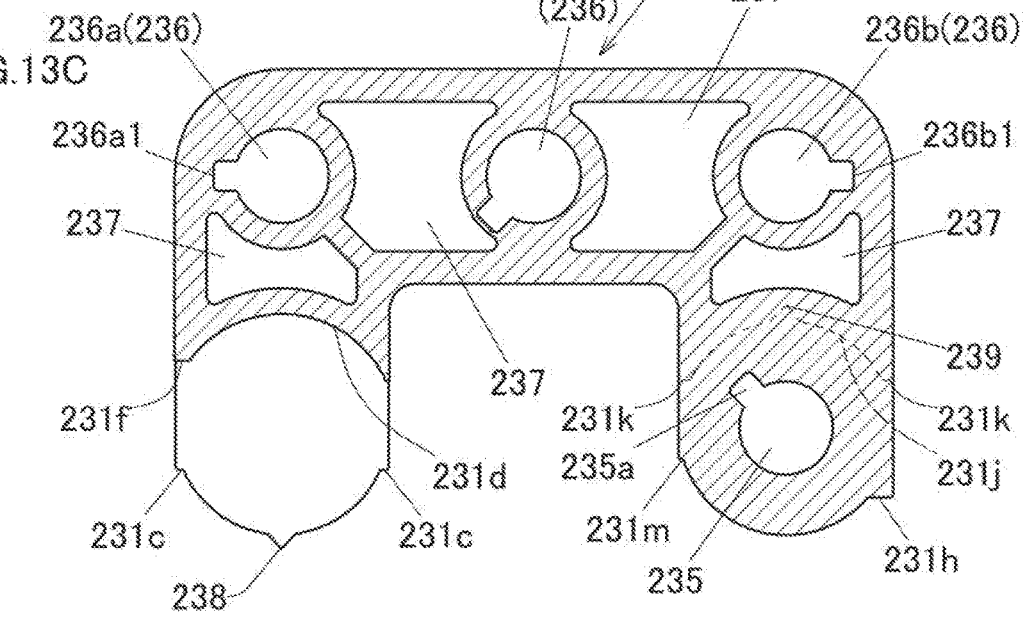
FIG. 13C is a sectional view of the third base member of the manual knitting device according to the second embodiment of the invention taken along a line C-C in FIG. 13B.

An inter-piece wall 231*d* is formed at a base or proximal portion of the bifurcated projecting end portion 231 to which the upper piece 231*a*1 and the lower piece 231*a*2 are connected, and this inter-piece wall 231*d* has a concavely receding arc shape when seen from thereabove as shown in FIG. 13C. A step portion 231*f* is formed at a left end portion of the inter-piece wall 231*d* having the concavely receding arc shape when seen from thereabove.

A third common hole portion 234 is provided at the bifurcated projecting portion 231*a*. The third common hole portion 234 has an upper hole 234*a* which penetrates the upper piece 231*a*1. The third common hole portion 234 has a diameter which is slightly larger than the outside diameter of the shaft portion 242 of the pin member 242 so that the shaft portion 242 can be inserted therethrough.

The other projecting end portion 231*b* is formed into a flat plate whose thickness is thinner than that of the main body portion 231*g*. A step portion 231*h* is formed at a right end portion of the projecting end portion 231*b* having the convexly projecting arc shape when seen from thereabove, and a step portion 231*m* is formed at a left end portion of the projecting end portion 231*b*. An upper and lower proximal end walls 231*j*, each having a concavely receding arc shape when seen from thereabove, are formed on an upper and lower sides of the projecting end portion 231*b* base or proximal portion of the other flat plate-shaped projecting portion 231*b* at a connecting portion of the projecting end portion 231*b* with the main body portion 231*g*.

A connecting engaging recess portion 239 is provided on each of the proximal end walls 231*j*. The connecting engaging recess portion 239 is formed as a V-shaped groove which extends along the proximal end wall 231*j* in the vertical direction. The connecting engaging recess portion 239 is provided in a middle position of the proximal end wall 231*j* having concavely receding arc shape when seen from thereabove. Step portions 231*k* are formed individually at ends of each of the upper and lower proximal end walls 231*j*.

Here, a space defined between the upper piece 231*a*1 and the lower piece 231*a*2 of the bifurcated projecting end portion 231*a* of this third base member 230 is configured so as to allow the other flat plate-shaped projecting end portion 231*b* of the other third base member 230 to be inserted thereinto. Further, the space defined between the upper piece 231*a*1 and the lower piece 231*a*2 of the bifurcated projecting end portion 231*a* is the same as the space defined between the upper piece 213*a*1 and the lower piece 213*a*2 of each of the end portions 211 of the first base member 210 shown in FIG. 11B. In addition, a thickness of the other projecting end portion 231*b* of the third base member 230 is the same as the thickness of the end portions 221*a* shown in FIG. 12B. Consequently, the projecting end portion 231*a* of the third base member 230 can be combined together the other projecting end portion 231*b* of the other third base member 230 and one of the end portions 221*a* of the second base member 220. Similarly, the other projecting end portion of the third base member 230 can be combined together with one of the end portions 211 of the first base member 210.

The other third common hole portion 235 is formed in the other projecting end portion 231*b*. A quadrangular engaging recess portion 235*a* is provided on the third common hole portion 235 with a bottom portion thereof caused to face outwards of a circumference of the hole. The engaging recess portion 235*a* is formed so as to extend along the other third common hole portion 235 from an upper end to a lower end thereof. The other third common hole portion 235 has such a diameter that enables the shaft portion 242 of the pin member 240 to be inserted thereinto.

Third hole portions 236*a*, 236*b* are formed in two corner portions where the third base member 230 having the U-shape when seen from thereabove is bent. Further, a third hole portion 236*c* is also formed between the two third hole portions 236*a*, 236*b*. Engaging recess portions 236*a*1, 236*b*1, 236*c*1 are formed on the third hole portions 236*a*, 236*b*, 236*c*, respectively, which are referred to as third hole portions 236 altogether. The third hole portions 236 have such a diameter that enables the shaft portion 242 of the pin member 40 to be inserted thereinto.

Further, four space portions 237 are provided on the periphery of the third hole portions 236 in the main body portion 231*g* of the third base member 230 which is formed from a resin material through injection molding as material removed portions. The space portions 237 are formed as non-through space portions.

As with the base 70 shown in FIG. 3, with the third base member 230 which is configured in the way described heretofore, a small quadrangular base can be formed by combining two third base members 230 together.

Figure 14:
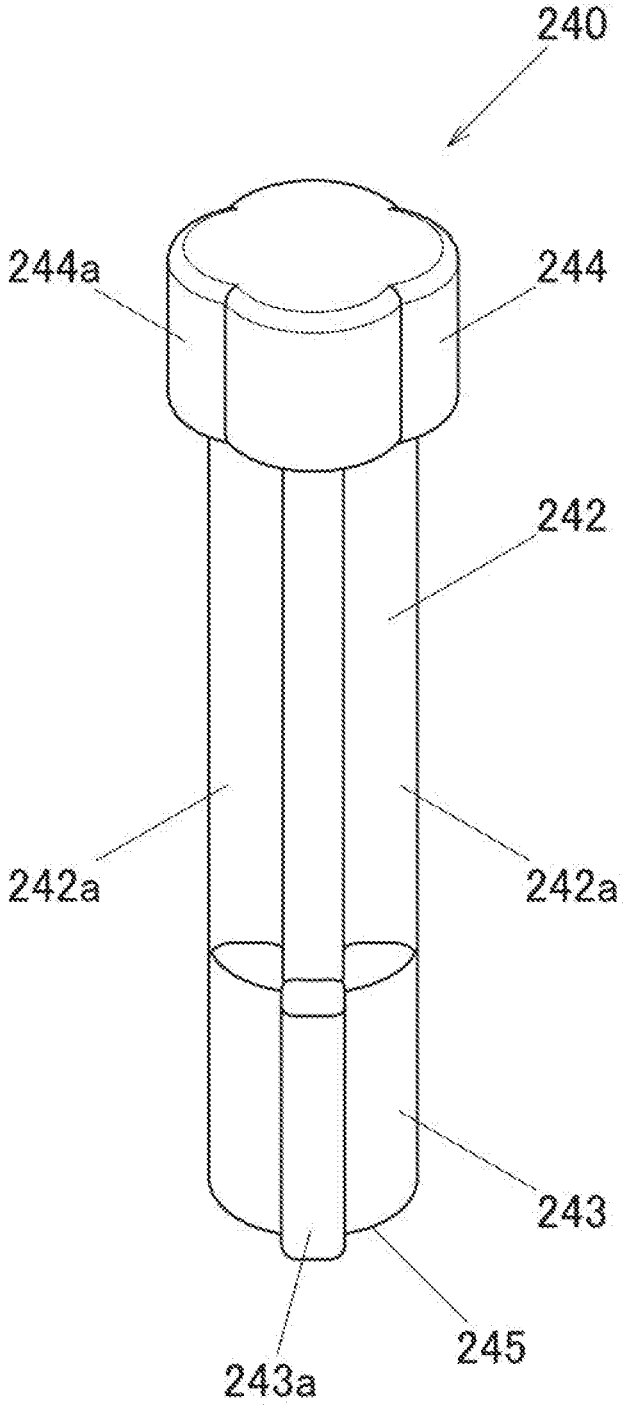
FIG. 14 is a perspective view showing a pin member of the manual knitting device according to the second embodiment of the invention.

Next, the pin member 240 will be described by reference to FIG. 14. The pin member 240 is formed by the shaft portion 242, a protuberant portion 244 which is formed at an upper end of the shaft portion 242 so as to protrude therefrom, and an inserting portion 243 which is formed at a lower end of the shaft portion 242. The shaft portion 242 has a substantially cruciform cross section. Consequently, four groove portions 242*a* are formed on the shaft portion 242 so as to extend along an axial direction thereof. When seen from thereabove, the protuberant portion 244 has a shape which is copied from so-called four-lobed clover. The shaft portion 242 is disposed about the axis thereof relative to the protuberant portion 244 in such away that the groove portions 242*a* are matched individually to root lines 244*a* of the protuberant portion 244. The inserting portion 243 has a circular cylindrical shape, and an engaging projecting portion 243*a* having a quadrangular cross section is formed to extend from an upper surface to a bottom surface of the inserting portion 243.

When inserting the pin member 240 into the first hole portion 215 of the first base member 210 shown in FIG. 11A, the engaging projecting portion 243*a* of the inserting portion 243 is brought into engagement with the engaging recess portion 215*b* of the first hole portion 215. The bottom surface 245 of the inserting portion 243 is brought into abutment with the hole bottom portion 215*a* of the first hole portion 215. Then, the pin member 240 is fixed in place in the first hole portion 215 so as not to rotate about the axis thereof. Similarly, also when inserting the pin member 240 into the second hole portion 225 of the second base member 220 shown in FIG. 12A and the third hole portions 236*a*, 236*b*, 236*c* of the third base member 230 shown in FIG. 13A, the engaging projecting portion 243*a* of the inserting portion 243 is brought into engagement with the engaging recess portions 225*a*, 236*a*1, 236*b*1, 236*c*1. In this way, an engaging portion is made up by the engaging projecting portion 243*a* of the inserting portion 243 of the pin member 240 and one of the engaging recess portions 215*b*, 224*a*, 225*a*, 236*a*1, 236*b*1, 236*c*1.

In addition, this pin member 240 can be inserted into a hole resulting when the first common hole portion 214 and the second common hole portion 224 are combined together coaxially in the vertical direction as a result of the first base member 210 shown in FIG. 11A and the second base member 220 shown in FIG. 12A being combined together. As this occurs, the engaging projecting portion 243*a* of the inserting portion 243 of the pin member 240 is brought into engagement with the engaging recess portion 224*a* of the second common hole portion 224. Following this, the bottom surface 245 of the inserting portion 243 is brought into abutment with the upper surface 214*b* of the lower piece 213*a*2 which is situated below the first common hole portion 214. Then, in such a state that the pin member 240 is not inserted into the first and second common hole portions 214, 224 which are combined coaxially, the first base member 210 and the second base member 220 are allowed to rotate relatively about the first and second common hole portions 214, 224 which are combined coaxially, whereas with the pin member 240 inserted into the first and second common hole portions 214, 224, the first base member 210 and the second base member 220 are restricted from rotating relatively.

Figure 15A:
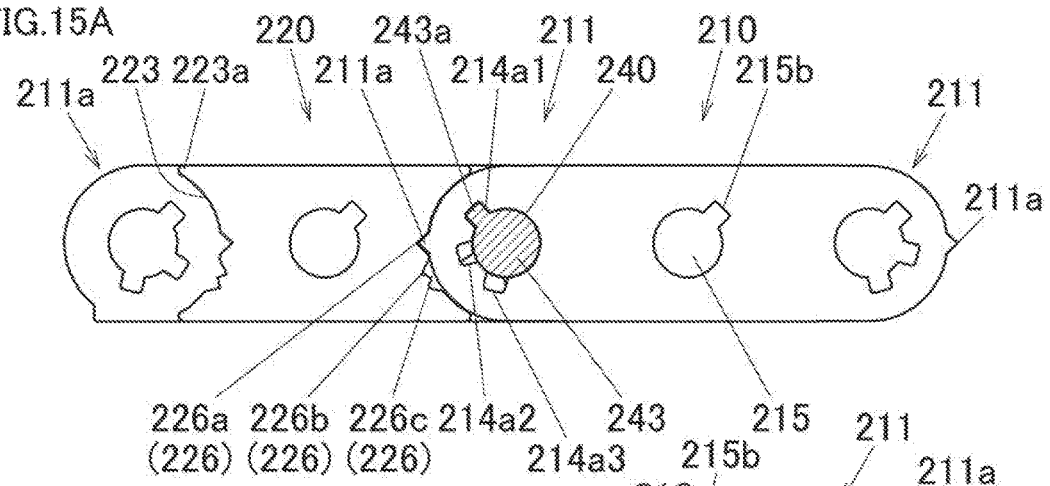
FIG. 15A is a plan view showing a connecting state of the first base member and the second base member of the manual knitting device according to the second embodiment of the invention in which the first base member and the second base member are connected together in a straight line.
Figure 15B:
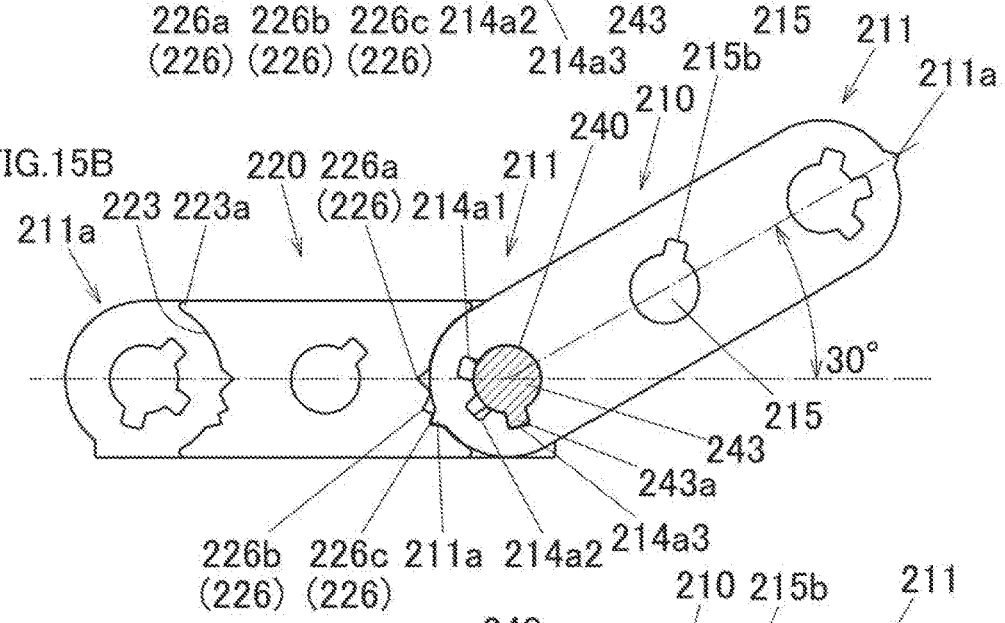
FIG. 15B is a plan view showing a connecting state of the first base member and the second base member of the manual knitting device according to the second embodiment of the invention in which the first base member and the second base member are connected to each other at an angle of 30 degrees.
Figure 15C:
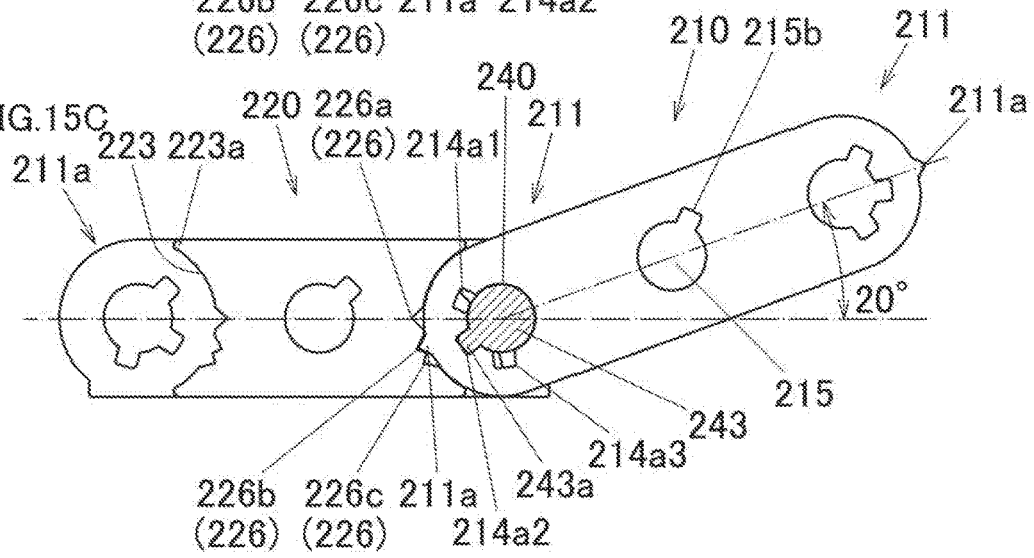
FIG. 15C is a plan view showing a connecting state of the first member base and the second base member of the manual knitting device according to the second embodiment of the invention in which the first base member and the second base member are connected to each other at an angle of 20 degrees.

How the first base member 210 and the second base member 220 rotate relatively is shown in FIGS. 15A to 15C. FIG. 15A shows a case where the connecting engagement projecting portion 211*a* of one of the end portions 211*a* of the first base member 210 is in engagement with the first engaging recess portion 226*a* of the other end portion 221*a* of the second base member 220. In this case, the first base member 210 and the second base member 220 are aligned in a straight line to be connected together.

The base 50 in the form shown in FIG. 1 can be made up by connecting the first base members 210 and the second base members 220 in a straight line, connecting the projecting end portion 231*a* of the third base member 230 with one of the end portions 221*a* of the second base member 220 and connecting the other projecting end portion 231*b* of the third base member 230 with one of the end portions 211 of the first base member 210. The base 50 so made up includes six first base members 210, six second base members 220 and two third base members 230.

Figure 16:
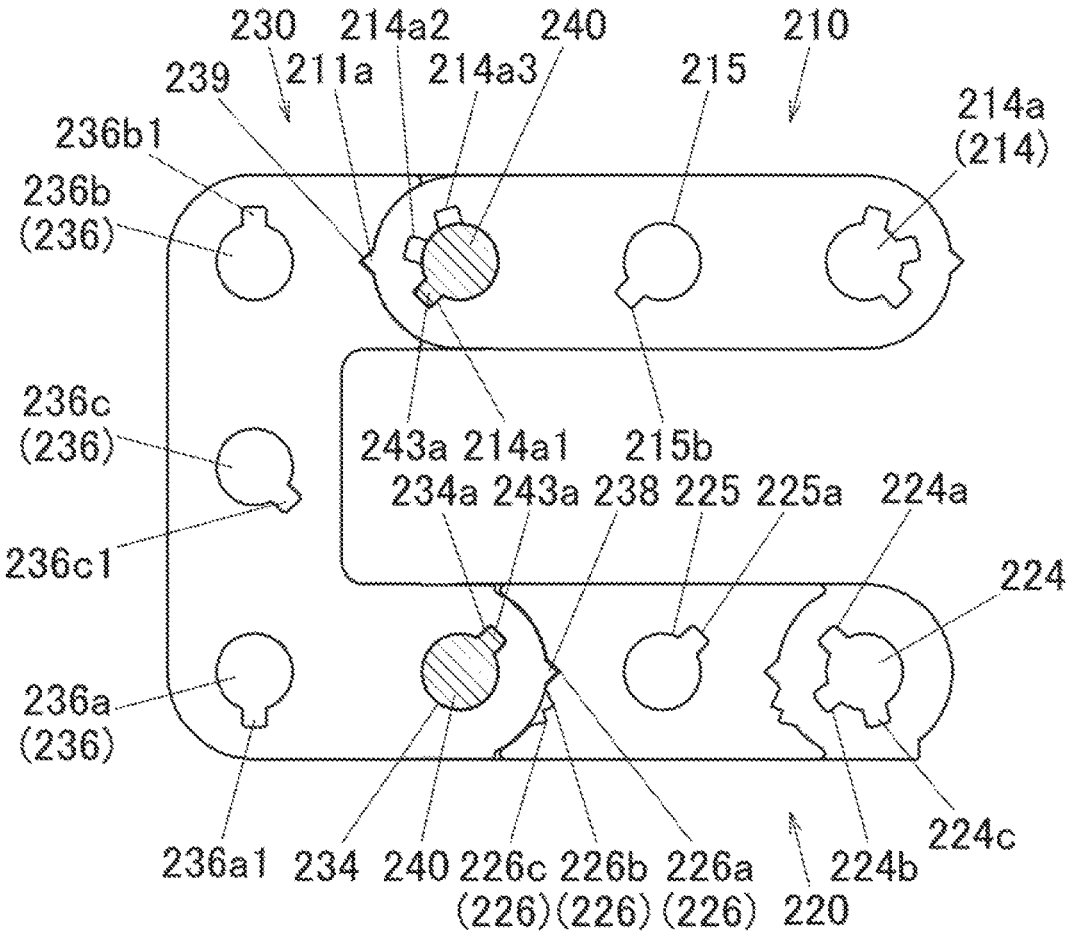
FIG. 16 is a plan view showing a state in which the first base member and the second base member are connected to the third base member of the manual knitting member according to the second embodiment of the invention.

Here, as shown in FIG. 16, the projecting end portion 231*a* of the third base member 230 is connected with one of the end portions 221*a* of the second base member 220 by inserting the inserting portion 243 of the shaft portion 242 of the pin member 240 into the third common hole portion 234 of the third base member 230 and the second common hole portion 224 of the second base member 220 which are aligned coaxially in the vertical direction. As this occurs, the engaging projecting portion 243*a* of the inserting portion 243 of the pin member 240 is brought into engagement with the engaging recess portion 224*a* of the second common hole portion 224, and the bottom surface 245 of the inserting portion 243 is brought into abutment with the upper surface 234*b* of the lower piece 231*a*. Consequently, the pin member 240 which is inserted commonly into the second common hole portion 224 and the third common hole portion 234 is fixed in place therein so as not to rotate about the axis thereof. When the third base member 230 and the second base member 220 are connected together, the first engaging recess portion 226*a* of one of the end portions 221*a* of the second base member 220 is brought into engagement with the engaging projecting portion 238 of the third base member 230, and the abutment end portion 221*a*4 is brought into abutment with the step portion 231*f*, whereby the second base member 220 is restricted from rotating relative to the third base member 230.

Similarly, the other projecting end portion 231*b* of the third base member 230 is connected with one of the end portions 211 of the first base member 210 by inserting the inserting portion 243 of the pin member 240 into the other third common hole portion 235 of the third base member 230 and the first common hole portion 214 of the first base member 210 which are aligned coaxially in the vertical direction. As this occurs, the engaging projecting portion 243*a* of the inserting portion 243 of the pin member 240 is brought into engagement with the engaging recess portion 214*a*1 of the first common hole portion 214 and the engaging recess portion 235*a* of the other third common hole portion 235, and the bottom surface 245 of the inserting portion 243 is brought into abutment with the upper surface 214*b* of the lower piece 213*a*2. Consequently, the pin member 240 which is inserted commonly into the first common hole portion 214 and the other third common hole portion 235 is fixed in place therein so as not to rotate about the axis thereof. Additionally, as this occurs, the step portion 231*h* of the third base member 230 is brought into abutment with the abutment portion 213*c* of the first base member 210, whereby the first base member 210 is restricted from rotating relative to the third base member 230.

As shown in FIGS. 15B and 15C, the first base member 210 and the second base member 220 can be rotated relatively about the axis of the first common hole portion 214 and the second common hole portion 224 into which the pin member 240 is inserted. In a state shown in FIG. 15B, the connecting engagement projecting portion 211*a* is brought into engagement with the third engaging recess portion 226*c*, whereby the first base member 210 and the second base member 220 are connected together at an angle of about 30 degrees by inserting the pin member 240 into the first common hole portion 214 and the second common hole portion 224. In the event that the first base member 210 and the second base member 220 are connected together in the way described above, the small circular base 60 shown in FIG. 2 or the small circular base 60 shown in FIG. 10A can be made up.

On the other hand, in a state shown in FIG. 15C, the connecting engagement projecting portion 211*a* is brought into engagement with the second engaging recess portion 226*b*, whereby the first base member 210 and the second base member 220 are connected together at an angle of about 20 degrees. In this case, the large circular base 60A shown in FIG. 10B can be made up.

As shown in FIG. 15A, the relative rotating direction of the first base member 210 and the second base member 220 is restricted to only one direction by the abutment of the abutment end portion 213*c* of the first base member 210 with the abutment end portion 221*a*4 of the second base member 220.

The connecting engagement portion made up of the connecting engagement recess portion 226 (the first engaging recess portion 226*a*, the second engaging recess portion 226*b*, the third engaging recess portion 226*c*) and the connecting engagement projecting portion 211*a* is made or released by the relative rotation of the first base member 210 and the second base member 220, whereby the relative rotational position between the first base member 210 and the second base member 220 can easily be determined. The manual knitting device according to the second embodiment may include a rotational position mark 18, a mark 26 and setting marks 19, 29, 39 as with the manual knitting device according to the first embodiment.

The engaging recess portions 214*a*1, 214*a*2, 214*a*3 of the first common hole portions 214 of the first base member 210, the engaging recess portions 224*a*, 224*b*, 224*c* of the second common hole portions 224 of the second base member 220, the engaging recess portion 234*a* of the third common hole portion 234 and the engaging recess portion 235*a* of the other third common hole portion 235 of the third base member 230 are fixed by the engaging projecting portions 243*a* of the inserting portions 243 of the pin members 240, whereby the first base member 210, the second base member 220 and the third base member 230 are connected strongly and rigidly.

Namely, in the case of the first engaging recess portion 226*a* of the connecting engagement recess portion 226 being brought into engagement with the connecting engagement projecting portion 211*a*, the engaging recess portion 214*a* communicates with the engaging recess portion 224*a*. Similarly, in the case of the second engaging recess portion 226*b* being brought into engagement with the connecting engagement projecting portion 211*a*, the engaging recess portion 214*a*3 communicates with the engaging recess portion 224*c*.

Figure 17:
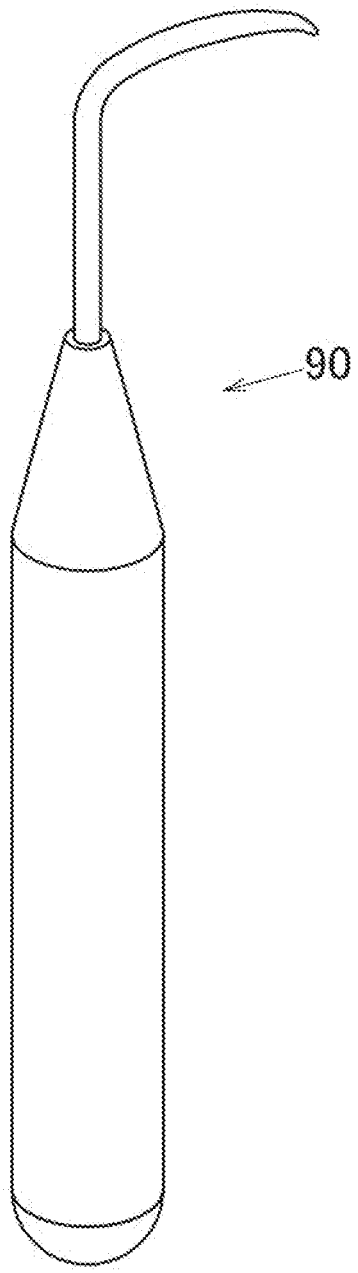
FIG. 17 is a perspective view of a hook which is used on the manual knitting devices according to the embodiments of the invention.
Figure 18:
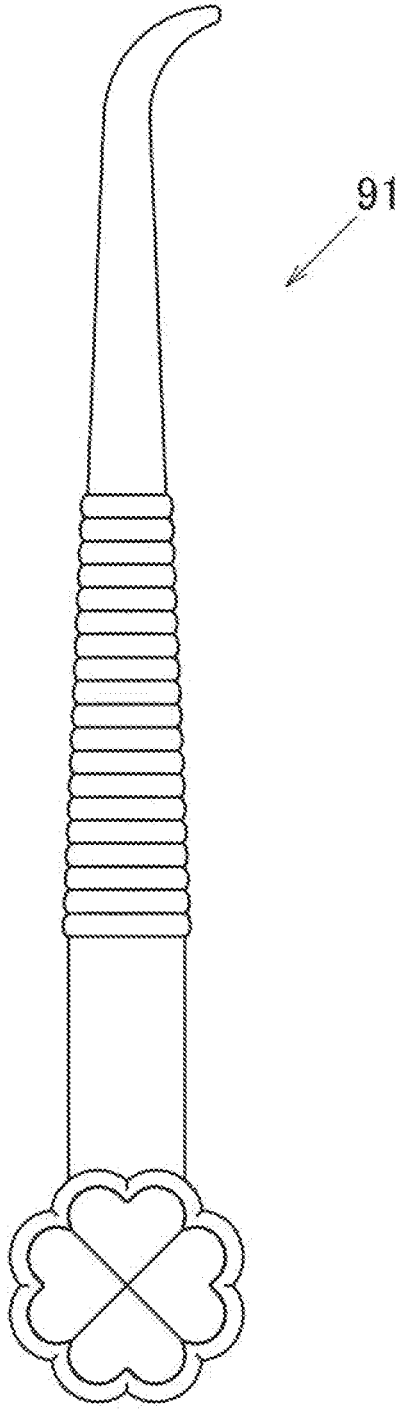
FIG. 18 is a perspective view of a hook of a different configuration which is used on the knitting devices according to the embodiments of the invention.

The manual knitting devices 1A, 1B, 1C which are built up as has been described heretofore adopts basically the following knitting method. In the event that a hook 90 shown in FIG. 17 is used, it is possible to prepare knitted fabric more simply and easily using the manual knitting devices 1A, 1B, 1C. In addition, in the event that a hook 91 shown in FIG. 18 is used, the operability and safety can be enhanced because even a child can hold the hook 91 easily and a distal end of the hook 91 is short.

Figure 19:
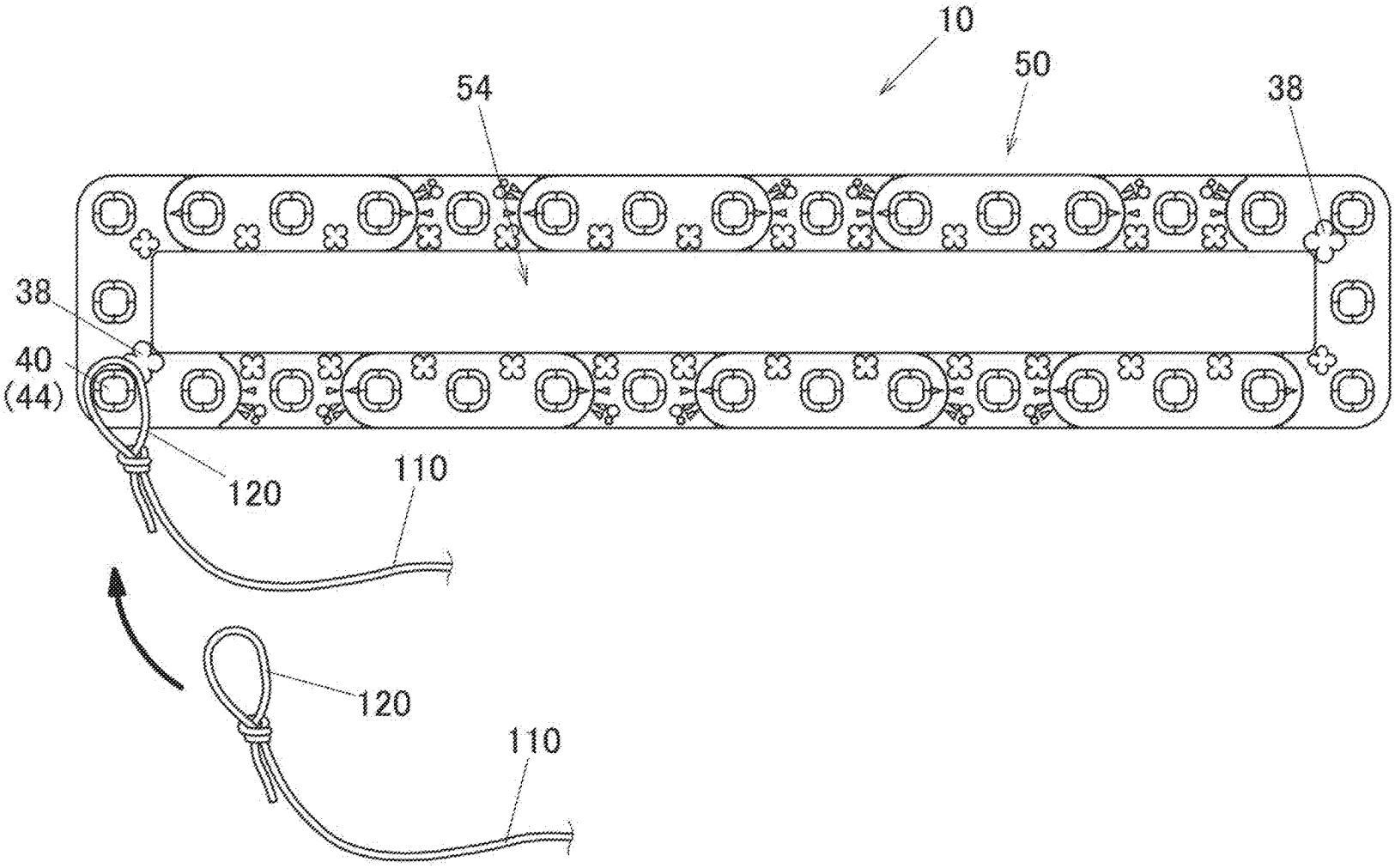
FIG. 19 is a view explaining a method of using the manual knitting devices according to the embodiments of the invention.

A basic knitting operation will be described based on FIGS. 19 and 20 by taking the form of the rectangular base 50 for example. Although the basic knitting operation will be described by using the manual knitting device according to the first embodiment, the manual knitting device according to the second embodiment also adopts the same knitting operation. Hence, the basic knitting operation adopted by the manual knitting device of the second embodiment will be omitted here. Firstly, as shown in FIG. 19, a loop 120 is formed at an end portion of yarn 110 such as wool. The loop 120 is hooked on the pin member 40. As this occurs, in the event that the yarn is hooked on the pin member 40 of the third base member 30 which lies close to the knitting start mark 38, the start of knitting can be recognized even in the middle of knitting.

Figure 20:
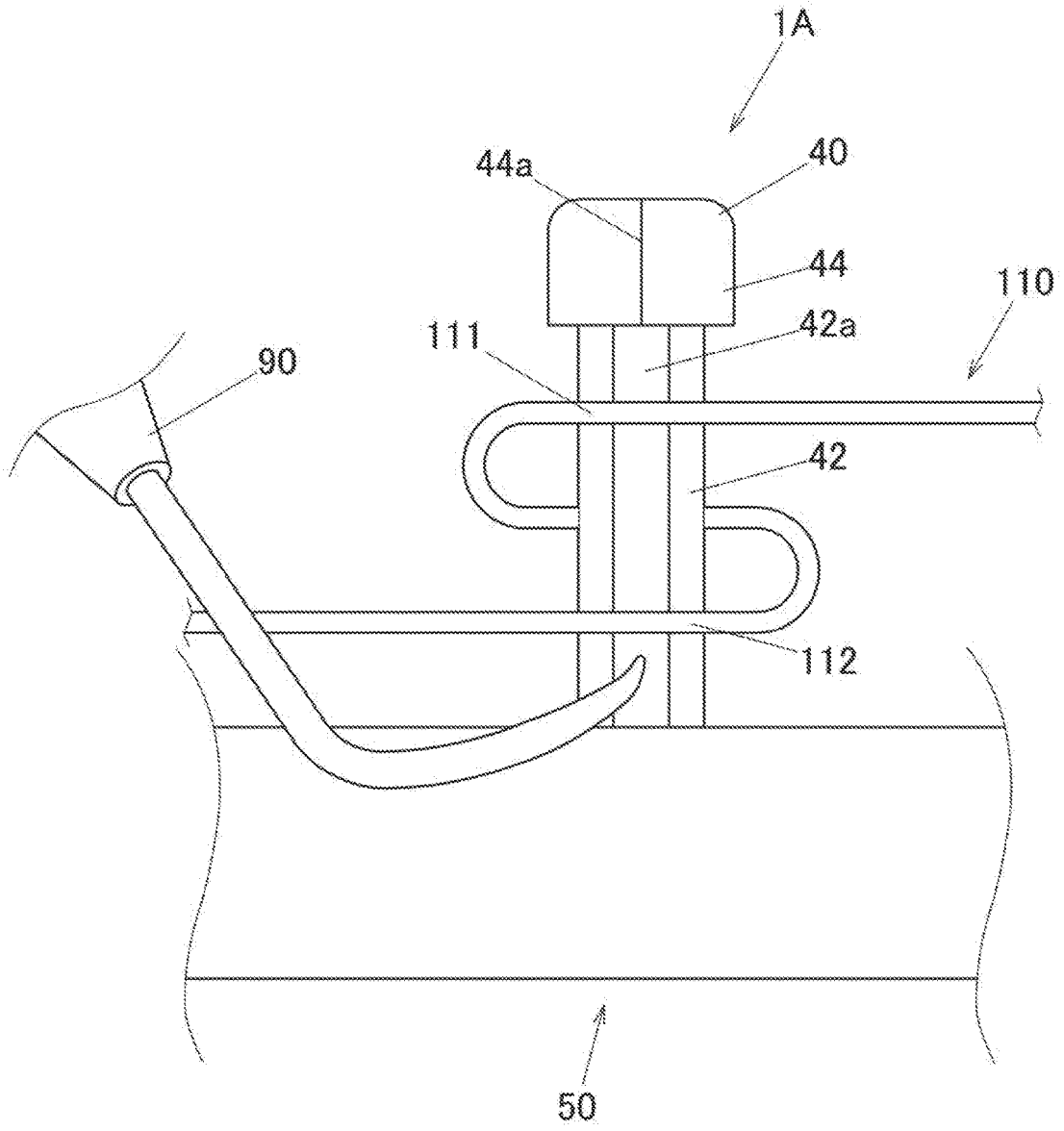
FIG. 20 is a view explaining a method of using the manual knitting devices according to the embodiments of the invention.

Next, as shown in FIG. 20, the yarn 110 is wound once around the adjacent pin member 40 from an outer side to an inner side of the manual knitting device 1A (the shaft portion 42) while stretching lightly the yarn 110. As this occurs, the yarn 110 is wound around the pin member 40 in such a way that the yarn which is turned back around the shaft portion 42 is disposed on an upper side (upper yarn 111). Then, a distal end of the hook 90 is caused to follow the groove portion 42*a* of the shaft portion 42 to lift up the yarn 110 disposed on a lower side (lower yarn 112) so that the lower yarn 112 is moved over the protuberant portion 44 of the pin member 40 so as to be positioned on an inner side (a side facing the opening portion 54). This series of operations is performed on all the pin members 40 and is repeated in a predetermined number of times, whereby knitted fabric is prepared. When knitted fabric of a predetermined size is prepared, the knitted fabric is removed from the manual knitting device 1A, and an end portion of the knitted fabric is treated properly or fastened with a knitting needle, whereby the knitted fabric is completed.

The user can select a sequence of hooking the yarn on the pin members 40 as required according to a kind of knitted fabric to be prepared. Additionally, a decorative article such as a bead can be passed over the yarn as required or can be engaged with the yarn to be knitted into knitted fabric in the middle of knitting. Further, the groove portions 42*a* are provided on the four sides of the pin member 40. Consequently, in the above description, the yarn wound around the pin member 40 is described as being turned back from the outer side to the inner side. However, the invention is not limited thereto, and hence, a knitting method can be adopted of turning back the yarn from the inner side to the outer side or from one side to the other side in a left-to-right direction of the pin member 40.

Thus, as has been described heretofore, it is possible to prepare the manual knitting devices 1A, 1B, 1C of different sizes and shapes easily by preparing the pluralities of first base members 10, second base members 20 and third base members 30 and connecting arbitrary numbers of first members 10, second members 20 and third members 30 together. Consequently, the user can prepare pieces of knitted fabric of various sizes and kinds easily.

Since the marks such as the setting marks 19, 29, 39 are provided as required on the upper surfaces of the constituent members and the rotational direction of the first base member 10 and the second base member 20 is restricted, the manual knitting devices 1A, 1B, 1C are prepared as a manual knitting device which is easy to be handled by people of a wide range of ages from children to adults.

Figure 21:
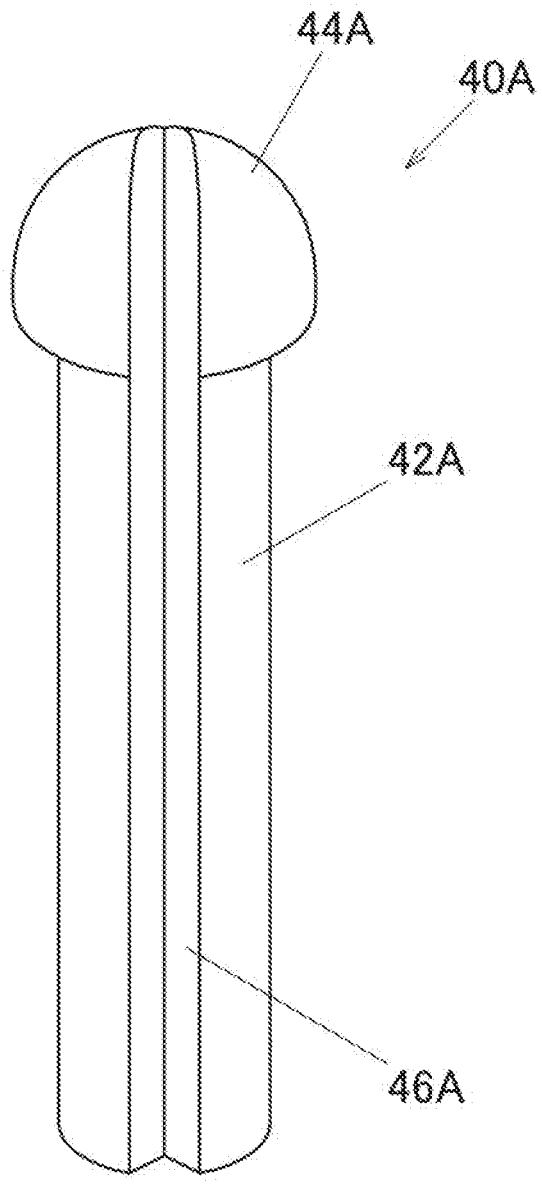
FIG. 21 is a perspective view showing a pin member of a different configuration which is used on the manual knitting devices according to the embodiments of the invention.

The invention is not limited to the embodiments that have been described above and hence can be carried out in various forms. For example, a pin member 40A shown in FIG. 21 can be used in place of the pin member 40 shown in FIG. 7. The pin member 40A is formed by a shaft portion 42A and a protuberant portion 44A. Then, a V-shaped groove portion 46A is provided along an axis of the shaft portion 42A from the shaft portion 42A to the protuberant portion 44A. According to the pin member 40A configured in the way described above, the yarn can easily be turned back across the protuberant portion 44A only by moving the distal end of the hook 90 from bottom to top along the groove portion 46.

Here, in the event that the manual knitting devices 1A, 1B, 1C are built up in such a way that the setting marks 19, 29, 39 are situated on the inner side, the engaging projecting portions 15*b*, 24*a*, 25*a*, 35*a*, 36*a*1, 36*c*1, 36*b*1 of the hole portions of the constituent members that can be brought into engagement with the groove portion 46A are caused to face the same side, that is, the outer side. Then, in the case of the pin member 40A shown in FIG. 21 being used, since the groove portion 46A is caused to face outwards at all times, the manual knitting device can easily be built up.

Figure 7:
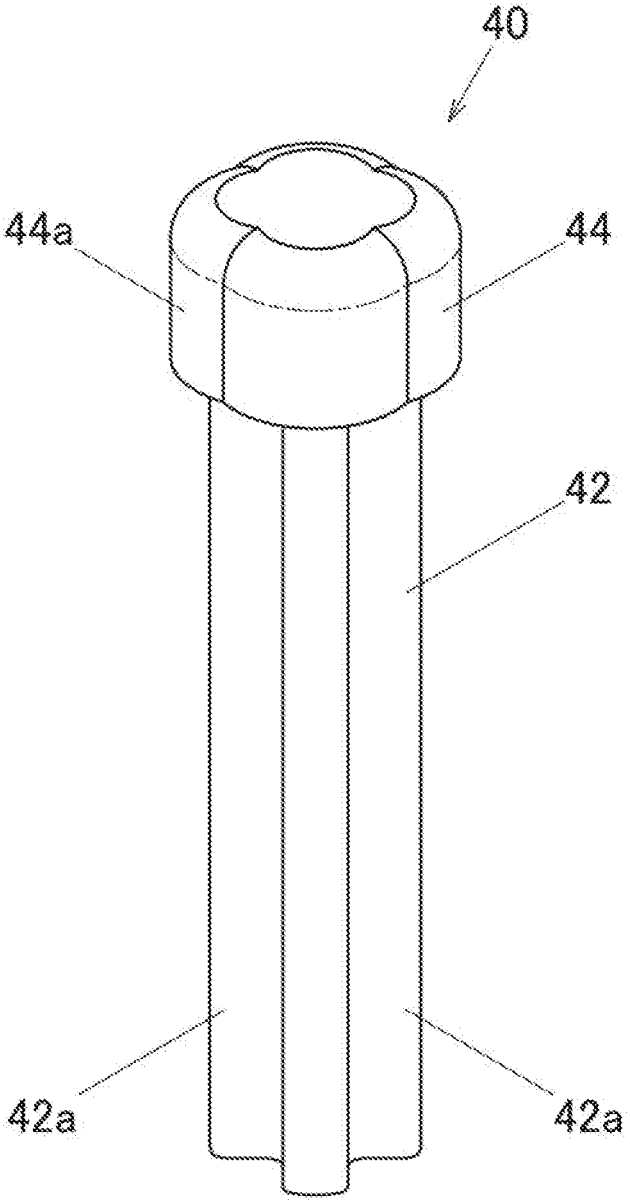
FIG. 7 is a perspective view showing a pin member of the manual knitting device according to the first embodiment of the invention.

In the event that the pin member 40 shown in FIG. 7 is inserted in the third hole portions 36*a*, 36*b* disposed at the two corner portions of the third base member 30, the yarn can be turned back from the two directions or four directions by the hook 90. For example, in the case of the manual knitting device 1A shown in FIG. 1, the yarn can be turned back to the inner side of the pin member 40 from either of the two directions or from either of the long side portion 51 side and the short side 52 side by moving the hook 90 along the groove portion 42*a* of the shaft portion 42.

The numbers of hole portions of the first base member 10, the second base member 20 and the third base member 30 are not limited to those described in the embodiments but can be increased or decreased as required. In addition, the pin member 40 can be given a different color from those of the first base member 10, the second base member 20 and the third base member 30. Alternatively, in the plurality of pin members, only the pin member which constitutes a mark such as a knitting start mark can be formed in a different color from those of the remaining pin members.

The engaging projecting portions 24*a* of the second common hole portions 24 of the second base member 20 can be deleted. Then, engaging projecting portions may be provided on the lower holes 14*b* of the first common hole portions 14 of the first base member 10 so as to be brought into engagement with the groove portion 42*a* of the pin member 40 or the groove portion 46A of the pin member 40A. As this occurs, the pin members 40, 40A are provided on the first base member 10 so as to be erected therefrom, so that knitting can be performed on the first base member 10 alone.

In addition, although a configuration can be adopted in which the engaging projecting portions 15*b*, 24*a*, 25*a*, 35*a*, 36*a*1, 36*c*1, 36*b*1 of the hole portions of the members which can be brought into engagement with the groove portion 42*a* or the groove portion 46A can be deleted so that the pin members 40, 40A are not fixed so as to rotate about the axes thereof, in the event that those engaging projecting portions are provided so that the pin members are fixed in place so as not to rotate about the axes thereof, knitting can preferably be facilitated.

What is claimed is:

1. A manual knitting device comprising:

a plurality of pin members each comprising a shaft portion and a protuberant portion which is formed on the shaft portion;

a first base member having a first common hole portion which extends through the first base member in a vertical direction and is formed so that the shaft portion of one of the plurality of pin members can be inserted into the first common hole portion and the first base member being formed into a first short rod shape; and a second base member having a second common hole portion which extends through the second base member in the vertical direction and is formed so that the shaft portion of the one of the plurality of pin members can be inserted into the second common hole portion and the second base member being formed into a second short rod shape, wherein the first base member and the second base member are formed so as to rotate relatively about the first common hole portion and the second common hole portion into which the one of the plurality of pin members is commonly inserted, wherein a connecting engaging portion is formed by a connecting engagement recess portion which is formed into either of the first base member or the second base member in a direction perpendicular to the vertical direction and a connecting engagement projecting portion which is formed on the other of the first base member and the second base member in the direction perpendicular to the vertical direction, wherein the connecting engagement recess portion and the connecting engagement projecting portion are configured to be engaged with each other according to the relative rotation of the first base member and the second base member.

2. The manual knitting device according to claim 1, wherein the first common hole portion is provided on each of end portions of the first base member, wherein the second common hole portion is provided on each of end portions of the second base member, wherein the end portions of the first base member are bifurcated, and wherein the end portions of the second base member are formed so as to be inserted into the bifurcated end portions of the first base member.

3. The manual knitting device according to claim 1, wherein the first base member has a first hole portion which is formed at a center portion of the first base member so that the shaft portion of one of the plurality of pin members can be inserted thereinto, and wherein the second base member has a second hole portion which is formed at a center portion of the second base member so that the shaft portion of one of the plurality of pin members can be inserted thereinto.

4. The manual knitting device according to claim 2, wherein the first base member has a first hole portion which is formed at a center portion of the first base member so that the shaft portion of one of the plurality of pin members can be inserted thereinto, and wherein the second base member has a second hole portion which is formed at a center portion of the second base member so that the shaft portion of one of the plurality of pin members can be inserted thereinto.

5. The manual knitting device according to claim 1, wherein an engaging projecting portion is formed at a lower portion of the shaft portion of one of the plurality of pin members, and wherein the first common hole portion or the second common hole portion has an engaging recess portion which can be brought into engagement with the engaging projecting portion.

6. The manual knitting device according to claim 2, wherein an engaging projecting portion is formed at a lower portion of the shaft portion of one of the plurality of pin members, and wherein the first common hole portion or the second common hole portion has an engaging recess portion which can be brought into engagement with the engaging projecting portion.

7. The manual knitting device according to claim 3, wherein an engaging projecting portion is formed at a lower portion of the shaft portion of one of the plurality of pin members, and wherein the first common hole portion or the second common hole portion has an engaging recess portion which can be brought into engagement with the engaging projecting portion.

8. The manual knitting device according to claim 5, wherein a plurality of engaging recess portions are formed at equal intervals.

9. The manual knitting device according to claim 5, wherein four groove portions are formed on a portion of the shaft portion which lies above the engaging projecting portion.

10. The manual knitting device according to claim 8, wherein four groove portions are formed on a portion of the shaft portion which lies above the engaging projecting portion.

* * * * *